US007946244B2

(12) United States Patent
Dowler et al.

(10) Patent No.: US 7,946,244 B2
(45) Date of Patent: May 24, 2011

(54) ASSURED GROUNDING IDENTIFIER

(76) Inventors: Aaron Dowler, Vancouver, WA (US); Joseph Jones, LaCenter, WA (US)

( * ) Notice: Subject to any disclaimer, the term of this patent is extended or adjusted under 35 U.S.C. 154(b) by 233 days.

(21) Appl. No.: 12/419,998

(22) Filed: Apr. 7, 2009

(65) Prior Publication Data

US 2009/0249993 A1 Oct. 8, 2009

Related U.S. Application Data

(60) Provisional application No. 61/123,635, filed on Apr. 8, 2008.

(51) Int. Cl.
*G09F 9/40* (2006.01)
*H01R 3/00* (2006.01)
*H01B 7/36* (2006.01)

(52) U.S. Cl. ..... 116/310; 116/307; 116/309; 116/316; 439/488; 439/491; 40/316; 174/112

(58) Field of Classification Search ..... 116/200, 116/202, 209, 278, 280, 298, 299, 306, 307, 116/309–320, 334, 335, DIG. 1; 439/488, 439/489, 491; 174/112; 40/5, 316, 443, 40/495, 502; D20/19, 20, 22, 28
See application file for complete search history.

(56) References Cited

U.S. PATENT DOCUMENTS

| | | | | | |
|---|---|---|---|---|---|
| 1,650,996 | A * | 11/1927 | McDonnell | 337/241 |
| 1,784,236 | A * | 12/1930 | Jones | 439/379 |
| 1,935,694 | A * | 11/1933 | Blufston | 40/495 |
| 4,764,126 | A * | 8/1988 | Piana et al. | 439/491 |
| 4,958,454 | A * | 9/1990 | Chan et al. | 40/495 |
| 5,115,586 | A * | 5/1992 | Hawker | 40/316 |
| 5,157,853 | A * | 10/1992 | Piana et al. | 40/316 |
| 6,311,637 | B1 * | 11/2001 | Moss | 116/200 |
| 6,420,657 | B1 * | 7/2002 | Fang et al. | 174/112 |
| 7,534,129 | B2 * | 5/2009 | Boldy | 439/491 |
| 7,612,288 | B1 * | 11/2009 | Gundogan et al. | 174/112 |

* cited by examiner

*Primary Examiner* — Amy Cohen Johnson
(74) *Attorney, Agent, or Firm* — Rylander & Associates PC; Kurt M. Rylander; Mark E. Beatty

(57) ABSTRACT

An assured grounding identifier includes a base unit connectable to an electrical cord, one or more indicators selectively adjustably mounted to the base unit and having colored regions, and a cover with one or more viewing windows aligned with the indicators. An assured grounding identifier includes a housing with a viewing window and a slot mountable around an electrical cord, an indicator having a plurality of colored regions disposed between the housing and the cord, and a tab extending from the indicator through the slot for positioning the indicator to align a selected colored region with the viewing window. An assured grounding identifier includes one or more indicators having a plurality of translucent color coded segments and an indicator light aligned with a viewing window to illuminate through the translucent color coded segments.

14 Claims, 19 Drawing Sheets

ASSURED GROUNDING IDENTIFIER

CROSS-REFERENCE TO RELATED APPLICATION

The present application claims priority to U.S. Provisional Application Ser. No. 61/123,635, filed Apr. 8, 2008, which is hereby incorporated by reference into the present application.

FIELD OF THE INVENTION

The present invention relates to safety devices for electrical cords. More particularly, the present invention relates to apparatus and methods for labeling electrical cords after safety checks.

BACKGROUND

"Assured grounding" is the requirement for quarterly or monthly inspection of all electrical cords depending on company requirements. Quarterly safety checks are mandated by OSHA, but many companies impose monthly requirements on themselves. All construction sites, factories, plants, mines and maintenance facilities that use portable electrical cords and power tools are required to comply. These inspections require a colored marking on all extension cords, temporary power cords (commonly referred to as "spider boxes"), power tool cords, cord splitters, and lighting cords. The color assures the worker that the cord was tested for effective ground path and defects. A nationwide color standard has been adopted in the United States by construction companies, united trades, mining companies and maintenance facilities. Quarterly periods are indicated as follows:

| QUARTERLY PERIOD | COLOR INDICATOR |
|---|---|
| January 1 through March 31 | White |
| April 1 through June 30 | Green |
| July 1 through September 30 | Red |
| October 1 through December 31 | Orange |

For facilities choosing or required to do monthly inspections, each month also has a color code as follows:

| MONTH | COLOR INDICATOR |
|---|---|
| January | White & neutral |
| February | White & Yellow |
| March | White & Blue |
| April | Green & neutral |
| May | Green & Yellow |
| June | Green & Blue |
| July | Red & neutral |
| August | Red & Yellow |
| September | Red & Blue |
| October | Orange & neutral |
| November | Orange & Yellow |
| December | Orange & Blue |

The indication "neutral" means that either no color indicator is used, or a color such as gray or black is used, matching the color of the plastic assured grounding identifier.

The standard method for marking cords at this time is wrapping the ends of the cord with bands of colored electrical tape. Tape leaves a dirty and sticky residue on the cords and can be messy. Some workers remove the tape by cutting it off with a pocket knife or razor blade which often results in injury to the employee or damage to the cord. Workers are often reluctant to obtain the correct colored tape, remove the old tape and replace it with the proper tape markings after inspection. The process is time consuming. Moreover, tape is not reusable and is expensive over time. Presently known art attempts to address this problem, but has not completely solved the problem.

Additionally, it would be desirable to provide enhanced visibility for an assured grounding indicator by combining it with a power on indicator light. Electrical cords have been constructed with a small light, generally an LED, embedded into the cord or plug which is electrically connected to the cord conductors, so that the light is illuminated whenever power is applied to the cord. Thus, safety could be enhanced by providing positive indication that proper ground checks have been performed, without hindering the live-cord indicator. These features could be embedded within a cord-plug structure, or attachable to a built-up cord plug.

Thus, there is a need for apparatus and methods to provide a simple and rugged means for indicating that scheduled safety checks have been performed on electrical cords, which (1) complies with the current industry standards for color coding, (2) eliminates the hazards of cutting tape identifiers off cords, (3) eliminates the problem of adhesive residue on cords, (4) is simple to administer, (5) saves labor time, (6) is reusable such that it can be transferred from old cords to new cords or can be made inexpensively enough to be disposable when a cord is disposed of; and, (7) can be combined with a power applied indicator light to enhance visibility.

SUMMARY AND ADVANTAGES

An assured grounding identifier includes a base unit having a cord clamp, a first indicator selectively adjustably mounted to the base unit and including a plurality of color-coded regions, an indicator cover connected to the base unit over at least the first indicator, the indicator cover including a first viewing window aligned with the first indicator with the first viewing window dimensioned to display a single color-coded region of the first indicator at a time. An assured grounding identifier includes a second indicator selectively adjustably mounted to the base unit and having a plurality of color-coded regions, wherein the indicator cover is connected to the base unit over both the first and second indicators, the indicator cover including a second viewing window aligned with the second indicator, with the second viewing window dimensioned to display a selected single color-coded region of the second indicator at a time.

An assured grounding identifier includes a base unit having a cord clamp and a locking ridge; a first indicator dial rotatingly mounted to the base unit, the first indicator dial including a display face having a plurality of color-coded regions, and a plurality of locking notches corresponding to the plurality of color-coded regions; and, a cover mounted to the base unit over at least the first indicator dial, the cover including a first viewing window aligned with the first indicator dial, the first viewing window dimensioned to display a selected single color-coded region of the first indicator dial at a time. An assured grounding includes a second indicator dial rotatingly mounted to the base unit, the second indicator dial including a display face having a plurality of color-coded regions, and a plurality of locking notches corresponding to the plurality of color-coded regions; and, wherein the cover is mounted to the base unit over both of the first and second indicator dials, the cover further including a second viewing window aligned with the second indicator dial, the second viewing window dimensioned to display a selected single color-coded region of the second indicator dial at a time.

An assured grounding identifier includes a housing having a front portion and a back portion, wherein the front portion includes first and second spring chutes and a locking ridge, and wherein the back portion includes attachment means for attaching the housing to an electrical cord; a first dial indicator rotatingly attached to the housing front portion through the first spring chute, the first dial indicator including a front surface and a back surface on opposing sides of the first dial indicator, four color-coded regions distributed symmetrically around the front surface of the first dial indicator, four locking grooves distributed symmetrically around the back surface of the first dial indicator for selectively engaging the locking ridge; a second dial indicator rotatingly attached to the housing front portion through the spring chute, and including a front surface and a back surface on opposing sides of the second dial indicator, six color-coded regions distributed symmetrically around the front surface of the second dial indicator, six locking grooves distributed symmetrically around the back surface of the second dial indicator for selectively engaging the locking ridge; and, a housing front cover attachable over the housing front portion and the first and second dial indicators, the front cover including first and second set screw access holes for accessing the first and second set screws, respectively, and further including first and second indicator windows positioned over the first and second dial indicators, respectively, for selectively displaying the color-coded regions. An assured grounding identifier includes first and second dial springs contained in the first and second spring chutes, respectively.

An assured grounding identifier includes a cylindrical base unit connectable around an electrical cord, the base unit including a first portion wherein the outer surface of the first portion includes a plurality of color-coded regions, disposed circumferentially around the first portion; and, a first rotating clip selectively rotatingly attachable around the base unit first portion, the first rotating clip including a first viewing window and first locking means for selectively locking the first rotating clip such that a selected color-coded region is visible through the first viewing window at a time. An assured grounding identifier includes wherein the cylindrical base unit has a second portion wherein the outer surface of the second portion includes a plurality of color-coded regions disposed circumferentially around the second portion, a second rotating clip selectively rotatingly attachable around the base unit second portion, the second rotating clip including a second viewing window, second rotating clip retaining means for retaining the second rotating clip to the base unit second portion, and second locking means for selectively locking the second rotating clip such that a selected color-coded region is visible through the second viewing window at a time.

An assured grounding identifier includes an open-biased inner indicator spring attachable to an electrical cord and a housing attachable to the electrical cord over the inner indicator spring; wherein the inner indicator spring comprises a hollow split-cylinder including a plurality of circumferential color-coded bands disposed along the outer surface of the cylinder and having an open seam disposed axially along a side of the cylinder and one or more finger clamps disposed along the open seam, each of said one or more finger clamps comprising a pair of projections on opposing sides of the open seam, such that compressing the pair of projections together closes the inner indicator spring; and, wherein the housing includes an indicator window for selectively viewing the plurality of color coded bands, an inner cavity for allowing the inner indicator spring to slide linearly along the electrical cord within the inner cavity when the housing is attached to the electrical cord around the inner spring indicator, a notched slot extending axially along a side of the housing including a plurality of notches along its length for selectively engaging the one or more finger clamp projections when the inner indicator spring is open so as to display a desired color coded band through the indicator window; and, first and second cord clamps disposed at opposing ends of the housing. An assured grounding identifier includes wherein the first and second cord clamps have receiving channels for receiving cable ties.

An assured grounding identifier includes a housing mountable around an electrical cord, the housing including a first viewing window and a slot; and an indicator having a plurality of color-coded regions and a positioning tab, the tab extendable through the slot when the indicator is installed between the housing and the electrical cord, and movable within the slot for selectively displaying a color-coded region through the viewing window. An assured grounding identifier includes wherein the housing includes first and second opposing viewing windows. An assured grounding identifier includes wherein the indicator having a plurality of color-coded regions comprises a flexible sheet having a plurality of color-coded bands, and wherein the positioning tab is formed by folding the flexible sheet and extending the fold-edge of the flexible sheet through the slot. An assured grounding identifier includes wherein the housing further includes one or more retaining lips and wherein the flexible sheet further includes one or more engaging flaps formed into the sheet, such that when the indicator is installed between the housing and the cord each of the engaging flaps engages a retaining lip.

The assured grounding identifier of the present invention presents numerous advantages, including: (1) complies with the current industry standards for color coding, (2) eliminates the hazards of cutting tape identifiers off cords, (3) eliminates the problem of adhesive residue on cords, (4) is simple to administer, (5) saves labor time, (6) is reusable such that it can be transferred from old cords to new cords or can be made inexpensively enough to be disposable when a cord is disposed of; and, (7) can be combined with a power applied indicator light to enhance visibility.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DRAWING REFERENCE NUMBERS

Figure 1:
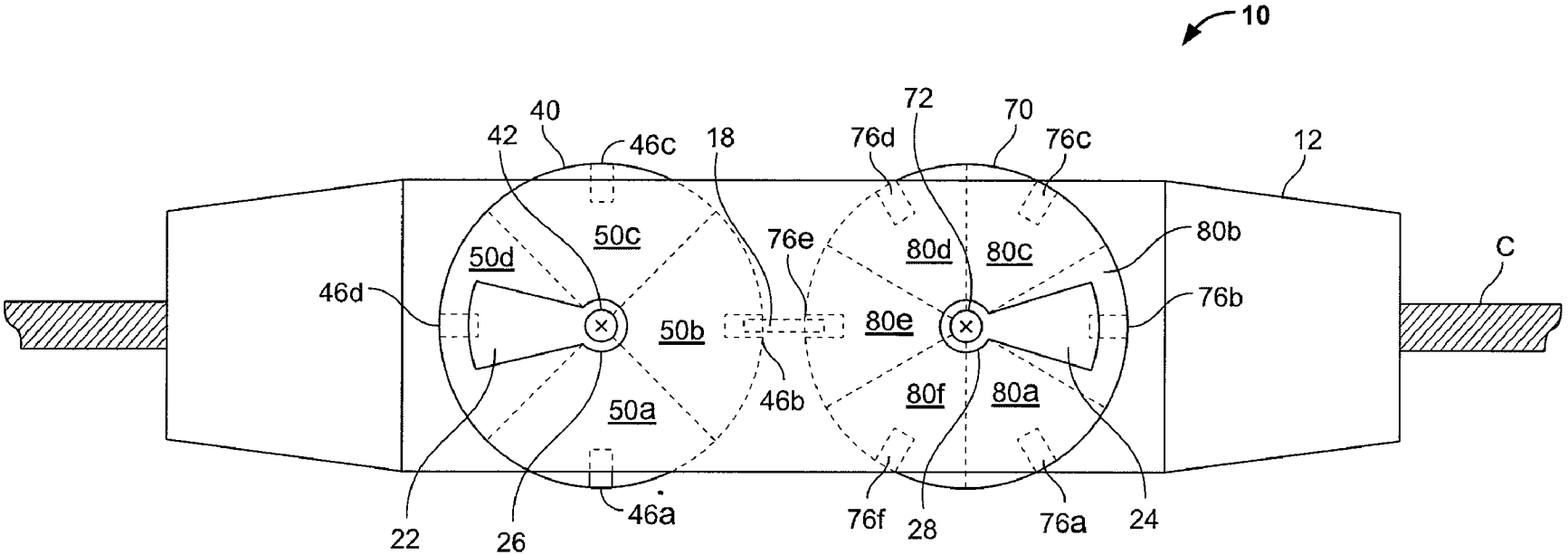
FIG. 1 shows a top view of a first embodiment of an assured grounding identifier.

The following list of drawing reference numbers is provided for convenience only.

| Number | Description |
|---|---|
| 10 | Assured Grounding Identifier |
| 12 | Base Unit |
| 14 | Display Side |
| 16 | Cord Clamp |
| 18 | Locking Ridge |
| 20 | Display Cover |
| 22 | First Display Window |
| 24 | Second Display Window |
| 26 | First Set Screw Access Hole |
| 28 | Second Set Screw Access Hole |
| 30 | Open Channel |
| 32 | Threaded Fasteners |
| 34 | Gripping Sheet |
| 40 | First Dial Indicator |
| 42 | Set Screw |
| 44 | First Dial Spring |
| 46a | Locking Notch |
| 46b | Locking Notch |
| 46c | Locking Notch |
| 46d | Locking Notch |
| 48 | First Dial Display Face |
| 50a | Color Coded Segment |
| 50b | Color Coded Segment |
| 50c | Color Coded Segment |
| 50d | Color Coded Segment |
| 70 | Second Dial Indicator |
| 72 | Set Screw |
| 74 | Second Dial Spring |
| 76a | Locking Notch |

-continued

| Number | Description |
|---|---|
| 76b | Locking Notch |
| 76c | Locking Notch |
| 76d | Locking Notch |
| 76e | Locking Notch |
| 76f | Locking Notch |
| 78 | Second Dial Display Face |
| 80a | Color Coded Segment |
| 80b | Color Coded Segment |
| 80c | Color Coded Segment |
| 80d | Color Coded Segment |
| 80e | Color Coded Segment |
| 80f | Color Coded Segment |
| 110 | Second Embodiment of Assured Grounding Identifier |
| 112 | Base Clamp |
| 112a | Base Clamp First Part |
| 112b | Base Clamp Second Part |
| 114 | Threaded Connectors |
| 116 | Gripping Sheet |
| 118a | First Open Channel |
| 118b | Second Open Channel |
| 120 | First Indicator Portion |
| 122 | First Flange Groove |
| 124 | Second Flange Groove |
| 126a | Color Coded Segment |
| 126b | Color Coded Segment |
| 126c | Color Coded Segment |
| 126d | Color Coded Segment |
| 128a | Receiving Slot |
| 128b | Receiving Slot |
| 128c | Receiving Slot |
| 128d | Receiving Slot |
| 140 | Second Indicator Portion |
| 142 | First Flange Groove |
| 144 | Second Flange Groove |
| 146a | Color coded segment |
| 146b | Color coded segment |
| 146c | Color coded segment |
| 146d | Color coded segment |
| 146e | Color coded segment |
| 146f | Color coded segment |
| 148a | Receiving Slot |
| 148b | Receiving Slot |
| 148c | Receiving Slot |
| 148d | Receiving Slot |
| 148e | Receiving Slot |
| 148f | Receiving Slot |
| 160 | First Rotator Clip |
| 162 | First Engaging Flange |
| 164 | Second Engaging Flange |
| 166 | Viewing Window |
| 168 | Locking Tooth |
| 170 | Thumb Grip |
| 172 | Rotator Clip Split |
| 180 | Second Rotator Clip |
| 182 | First Engaging Flange |
| 184 | Second Engaging Flange |
| 186 | Viewing Window |
| 188 | Locking Tooth |
| 190 | Thumb Grip |
| 192 | Rotator Clip Split |
| 310 | Third Embodiment of Assured Grounding Identifier |
| 312 | Inner Indicator Spring |
| 314 | Finger Clamp |
| 314a | Finger Clamp Projection |
| 314b | Finger Clamp Projection |
| 316 | Finger Clamp |
| 316a | Finger Clamp Projection |
| 316b | Finger Clamp Projection |
| 318 | Open Seam |
| 326 | Indicator Surface |
| 326a | Color Coded Band |
| 326b | Color Coded Band |
| 326c | Color Coded Band |
| 326d | Color Coded Band |
| 340 | Outer Clamp |
| 342 | Indicator Window |
| 344 | Inner Cavity |
| 346 | Notched Slot |

-continued

| Number | Description |
|---|---|
| 348 | Notches |
| 350 | Cord Clamp |
| 352 | First Receiving Channel |
| 354 | Second Receiving Channel |
| 356 | Cable Tie |
| 358 | Cable Tie |
| 410 | Fourth Embodiment of an Assured Grounding Identifier |
| 412 | Indicator Sheet |
| 414 | Fold Edge |
| 416 | Positioning Tab |
| 418 | First Wing Section |
| 420 | Second Wing Section |
| 422 | Indicator Tab First Edge |
| 424 | Indicator Tab Second Edge |
| 426a | Color Coded Band |
| 426b | Color Coded Band |
| 426c | Color Coded Band |
| 426d | Color Coded Band |
| 428 | First Engaging Flap |
| 430 | Second Engaging Flap |
| 432 | Side Engaging Flap |
| 434 | Side Engaging Flap |
| 436 | Side Engaging Flap |
| 438 | Side Engaging Flap |
| 440 | Housing |
| 440a | Housing First Part |
| 440b | Housing Second Part |
| 442 | First Viewing Window |
| 444 | Second Viewing Window |
| 446 | Slot |
| 450 | First Cord Clamp |
| 452 | Second Cord Clamp |
| 456 | First Cable Tie |
| 458 | Second Cable Tie |
| 460 | First Cable Tie Lock |
| 462 | Second Cable Tie Lock |
| 464 | First Hinge Connector |
| 466 | Second Hinge Connector |
| 468 | First Flange |
| 470 | Second Flange |
| 472 | Third Flange |
| 474 | Fourth Flange |
| 476 | Flange Interior Lip |
| 478 | Flange Interior Lip |
| 480 | Flange Interior Lip |
| 482 | Flange Interior Lip |
| 484 | End Clamp Pronds |
| 486 | Ridges |
| 510 | Fifth Embodiment of an Assured Grounding Identifier |
| 512 | Base Unit |
| 518 | Locking Ridge |
| 520 | Display Cover |
| 522 | First Display Window |
| 526 | First Set Screw Access Hole |
| 540 | First Dial Indicator |
| 542 | Set Screw |
| 544 | First Dial Spring |
| 546a | Locking Notch |
| 546b | Locking Notch |
| 546c | Locking Notch |
| 546d | Locking Notch |
| 548 | First Dial Display Face |
| 550a | Color Coded Segment |
| 550b | Color Coded Segment |
| 550c | Color Coded Segment |
| 550d | Color Coded Segment |
| C | Cord |

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

An assured grounding identifier includes a base unit having a cord clamp, a first indicator selectively adjustably mounted to the base unit and including a plurality of color-coded regions, an indicator cover connected to the base unit over at least the first indicator, the indicator cover including a first viewing window aligned with the first indicator with the first viewing window dimensioned to display a single color-coded region of the first indicator at a time. An assured grounding identifier includes a second indicator selectively adjustably mounted to the base unit and having a plurality of color-coded regions, wherein the indicator cover is connected to the base unit over both the first and second indicators, the indicator cover including a second viewing window aligned with the second indicator, with the second viewing window dimensioned to display a selected single color-coded region of the second indicator at a time.

An assured grounding identifier includes a base unit having a cord clamp and a locking ridge; a first indicator dial rotatingly mounted to the base unit, the first indicator dial including a display face having a plurality of color-coded regions, and a plurality of locking notches corresponding to the plurality of color-coded regions; and, a cover mounted to the base unit over at least the first indicator dial, the cover including a first viewing window aligned with the first indicator dial, the first viewing window dimensioned to display a selected single color-coded region of the first indicator dial at a time. An assured grounding includes a second indicator dial rotatingly mounted to the base unit, the second indicator dial including a display face having a plurality of color-coded regions, and a plurality of locking notches corresponding to the plurality of color-coded regions; and, wherein the cover is mounted to the base unit over both of the first and second indicator dials, the cover further including a second viewing window aligned with the second indicator dial, the second viewing window dimensioned to display a selected single color-coded region of the second indicator dial at a time.

An assured grounding identifier includes a housing having a front portion and a back portion, wherein the front portion includes first and second spring chutes and a locking ridge, and wherein the back portion includes attachment means for attaching the housing to an electrical cord; a first dial indicator rotatingly attached to the housing front portion through the first spring chute, the first dial indicator including a front surface and a back surface on opposing sides of the first dial indicator, four color-coded regions distributed symmetrically around the front surface of the first dial indicator, four locking grooves distributed symmetrically around the back surface of the first dial indicator for selectively engaging the locking ridge; a second dial indicator rotatingly attached to the housing front portion through the spring chute, and including a front surface and a back surface on opposing sides of the second dial indicator, six color-coded regions distributed symmetrically around the front surface of the second dial indicator, six locking grooves distributed symmetrically around the back surface of the second dial indicator for selectively engaging the locking ridge; and, a housing front cover attachable over the housing front portion and the first and second dial indicators, the front cover including first and second set screw access holes for accessing the first and second set screws, respectively, and further including first and second indicator windows positioned over the first and second dial indicators, respectively, for selectively displaying the color-coded regions. An assured grounding identifier includes first and second dial springs contained in the first and second spring chutes, respectively.

An assured grounding identifier includes a cylindrical base unit connectable around an electrical cord, the base unit including a first portion wherein the outer surface of the first portion includes a plurality of color-coded regions, disposed circumferentially around the first portion; and, a first rotating clip selectively rotatingly attachable around the base unit first portion, the first rotating clip including a first viewing window and first locking means for selectively locking the first rotating clip such that a selected color-coded region is visible through the first viewing window at a time. An assured grounding identifier includes wherein the cylindrical base unit has a second portion wherein the outer surface of the second portion includes a plurality of color-coded regions disposed circumferentially around the second portion, a second rotating clip selectively rotatingly attachable around the base unit second portion, the second rotating clip including a second viewing window, second rotating clip retaining means for retaining the second rotating clip to the base unit second portion, and second locking means for selectively locking the second rotating clip such that a selected color-coded region is visible through the second viewing window at a time.

An assured grounding identifier includes an open-biased inner indicator spring attachable to an electrical cord and a housing attachable to the electrical cord over the inner indicator spring; wherein the inner indicator spring comprises a hollow split-cylinder including a plurality of circumferential color-coded bands disposed along the outer surface of the cylinder and having an open seam disposed axially along a side of the cylinder and one or more finger clamps disposed along the open seam, each of said one or more finger clamps comprising a pair of projections on opposing sides of the open seam, such that compressing the pair of projections together closes the inner indicator spring; and, wherein the housing includes an indicator window for selectively viewing the plurality of color coded bands, an inner cavity for allowing the inner indicator spring to slide linearly along the electrical cord within the inner cavity when the housing is attached to the electrical cord around the inner spring indicator, a notched slot extending axially along a side of the housing including a plurality of notches along its length for selectively engaging the one or more finger clamp projections when the inner indicator spring is open so as to display a desired color coded band through the indicator window; and, first and second cord clamps disposed at opposing ends of the housing. An assured grounding identifier includes wherein the first and second cord clamps have receiving channels for receiving cable ties.

An assured grounding identifier includes a housing mountable around an electrical cord, the housing including a first viewing window and a slot; and an indicator having a plurality of color-coded regions and a positioning tab, the tab extendable through the slot when the indicator is installed between the housing and the electrical cord, and movable within the slot for selectively displaying a color-coded region through the viewing window. An assured grounding identifier includes wherein the housing includes first and second opposing viewing windows. An assured grounding identifier includes wherein the indicator having a plurality of color-coded regions comprises a flexible sheet having a plurality of color-coded bands, and wherein the positioning tab is formed by folding the flexible sheet and extending the fold-edge of the flexible sheet through the slot. An assured grounding identifier includes wherein the housing further includes one or more retaining lips and wherein the flexible sheet further includes one or more engaging flaps formed into the sheet, such that when the indicator is installed between the housing and the cord each of the engaging flaps engages a retaining lip.

An assured grounding identifier includes a base unit connected to an electrical cord having conductors therein a first indicator selectively adjustably mounted to the base unit, the first indicator including a plurality of translucent color-coded regions; an indicator cover connected to the base unit over at least the first indicator, the indicator cover including a first viewing window aligned with the first indicator, the first viewing window dimensioned to display a single color-coded region of the first indicator at a time; and, a first indicator light contained within the base unit and aligned with the first viewing window, the light in electrical communication with the conductors such that the first indicator light illuminates when power is applied to the conductors. An assured grounding identifier includes a second indicator selectively adjustable mounted to the base unit, the second indicator including a plurality of translucent color-coded regions; the indicator cover connected to the base unit over both the first and second indicators, the indicator cover including a second viewing window aligned with the second indicator, the second viewing window dimensioned to display a selected single color-coded region of the second indicator at a time; and a second indicator light contained within the base unit and aligned with the second viewing window, the light in electrical communication with the conductors such that the second indicator light illuminates when power is applied to the conductors.

Figure 2:
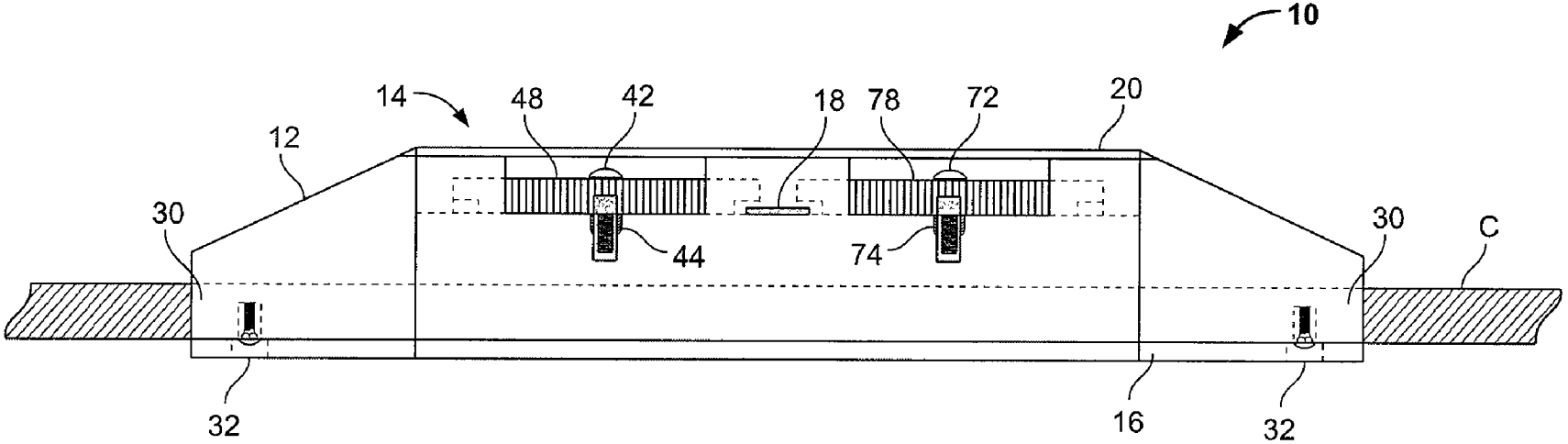
FIG. 2 shows a side-view cross section of a first embodiment of an assured grounding identifier.
Figure 3:
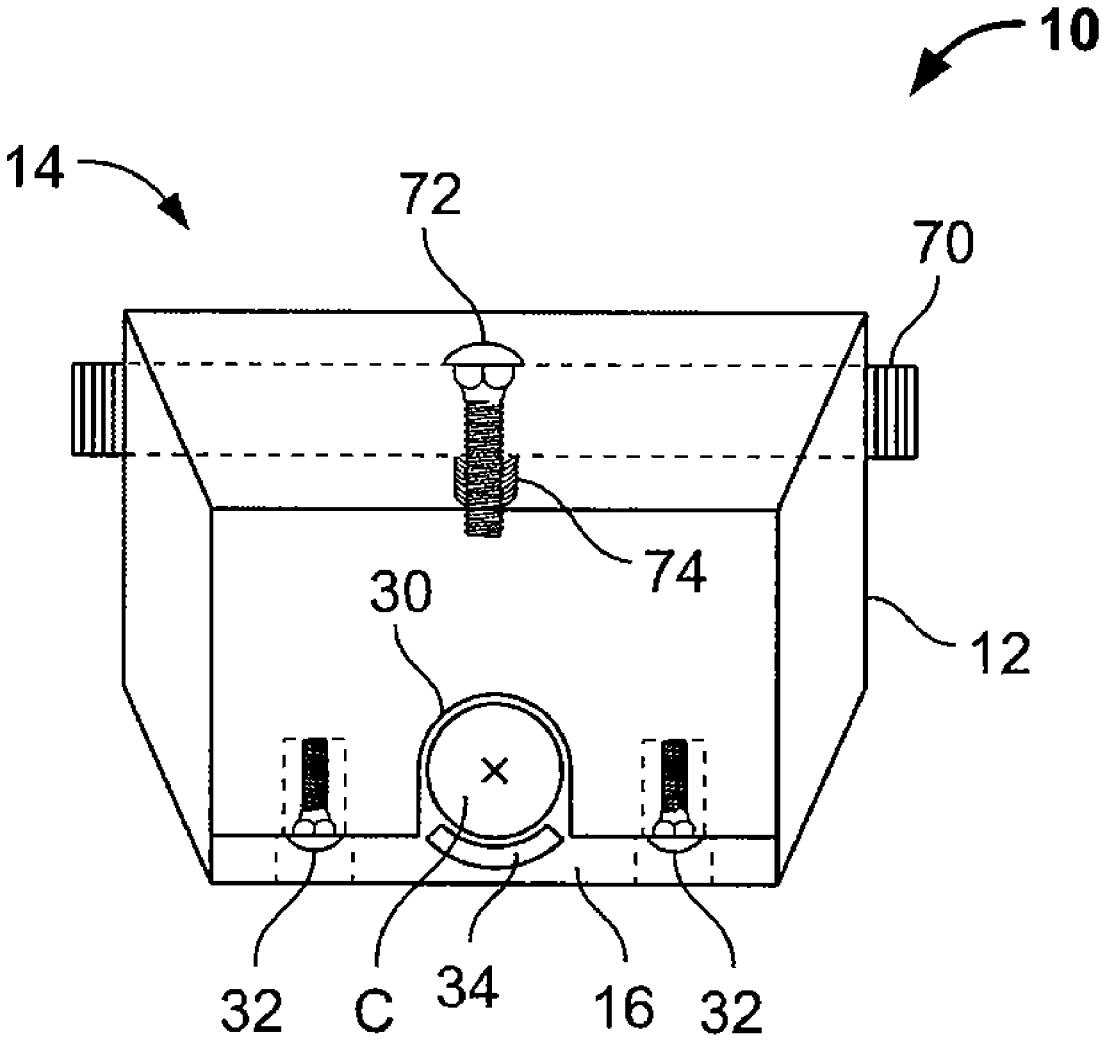
FIG. 3 shows an end-view cross section of a first embodiment of an assured grounding identifier.

Referring to FIGS. 1-3, in a first embodiment an assured grounding identifier 10 is provided including a base unit 12 with a display side 14 and cord clamp 16 for attaching to an electrical cord C. First and second dial indicators 40 and 70, respectively, are rotatingly connected to the display side 14 of base unit 12 using set screws 42 and 72, respectively. Base unit 12 includes a locking ridge 18 for engaging locking notches 46*a-d* and 76*a-f* on dial indicators 40 and 70, respectively. In an embodiment, base unit 12 includes a single locking ridge 18 disposed between first and second indicator dials 40 and 70. Alternatively, base unit 12 could include a distinct locking ridge for each of first and second indicator dials 40 and 70.

First and second dial indicators 40 and 70 receive first and second set screws 42 and 72 through their respective central axes. Set screws 42 and 72 thread into base unit 12 to retain first and second dial indicators 40 and 70 in place after aligning them over locking ridge 18.

First and second dial indicators 40 and 70 include first and second dial springs 44 and 74, respectively. Dial springs 44 and 74 lift dial indicators 40 and 70 away from base unit 12 and clear of locking ridge 18 when set screws 42 and 72 are loosened, thereby allowing an operator to freely turn dial indicators 40 and 70. Locking notches 46*a-d* and 76*a-f* must be aligned over locking ridge 18 to display the correct color code, at which point set screws 42 and 72 are tightened, compressing dial springs 44 and 74 and engaging the selected locking notches 46 and 76 onto locking ridge 18 to prevent rotation.

Preferably first and second indicator dials 40 and 70 are substantially flat and cylindrical in shape. As shown in FIGS. 1-3, in an embodiment first and second indicator dials 40 and 70 are thin cylinders or wafer style.

First indicator dial 40 includes a display face 48 with four color coded segments 50*a-d* arranged symmetrically around the central axis and corresponding to the designated quarterly colors: white, green, red, and orange. Preferably the four color coded segments 50*a-d* are shaped wedge-shaped like pieces of a pie. Alternatively the four color coded segments 50*a-d* could consist of colored strips oriented radially outward, or colored dots where the dots are large enough to be easily visible. First indicator dial 40 includes four locking notches 46*a-d* distributed symmetrically around the central axis for engaging locking ridge 18. Preferably locking notches 46*a-d* are disposed on an opposing side from display face 48. Alternatively, locking notches 46*a-d* could be cut through the perimeter edge of first indicator dial 40. In another alternative, locking ridge 18 could consist of a protrusion, and locking notches 46*a-d* could consist of detents aligned to receive the protrusions when indicator dial 40 is rotated to display a selected color coded segment 50*a-d*.

Second indicator dial 70 is similar to first dial indicator 40, but includes a display face 78 with six color coded segments 80*a-f* arranged symmetrically around the central axis and corresponding to the designated monthly colors: green, white, red, orange, blue, and yellow. Preferably the six color coded segments 80*a-f* are wedge-shaped like pieces of a pie. Alternatively the six color coded segments 80*a-f* could consist of color coded strips oriented radially outward, or color coded dots where the dots are large enough to be easily visible. The six segments could be reduced to three segments, or some other color coding scheme to indicate other-than-quarterly checks.

The first and second indicator dials 40 and 70 may include tactile indicators corresponding to the color codes to assist where visibility is poor or the user is color blind. Such raised indicators could consist of a series of detents, indents, or raised ridges which a person could discern by touching with their fingers.

Display cover 20 attaches to base unit 12 over first and second indicator dials 40 and 70. Display cover 20 includes first and second display windows 22 and 24, respectively, and first and second set screw access holes 26 and 28, respectively. First display window 22 is positioned such that when a first indicator dial locking notch 46*a-d* engages locking ridge 18 only one of color coded segments 50*a-d* is visible through first display window 22. Likewise, second display window 24 is positioned such that when a second indicator dial locking notch 76*a-f* engages locking ridge 18, only one of color coded segments 80*a-f* is visible through second display window 24. Preferably display cover 20 snaps closed over first and second dial indicators 40 and 70 only in the correct direction, such as by including a single snap latch at one end and two snap latches at the opposite end, so as to prevent inadvertently aligning the first display window 22 (indicating the calendar quarter) over the second indicator 70 (indicating the calendar month).

Cord clamp 16 provides firm attachment to an electrical cord C between a base unit 12 and clamp 16. In an embodiment base unit 12 includes an open channel 30 for receiving electrical cord C and clamp 16 is attached over open channel 30 using threaded fasteners 32, so that the cord C is snuggly clamped and the grounding identifier 10 does not slide on the cord C. Gripping sheet 34 may be included to wrap around cord C in order to protect cord C from chafing and provide enhanced gripping. Different thicknesses of sheet 34 may be provided so that a single sized channel 30 may accommodate cords of varying diameters. Preferably gripping sheet 34 is made from foam rubber for its compressibility, grippiness, and electrical insulation properties.

In operation of the first embodiment, an operator conducts ground checks and safety inspections required for the particular month on cord C in accordance with accepted procedures. If the cord passes the checks then the operator will indicate acceptance using the assured grounding identifier. The operator indicates the quarter by loosening set screw 42 allowing spring 44 to push first dial indicator 40 up until locking notch 46 clears locking ridge 18. The operator turns first dial indicator 40 until the correct color section 50 shows through first viewing window 22 to correspond to the calendar quarter, and the corresponding locking notch 46 is aligned with locking ridge 18, at which point set screw 42 is tightened down. The operation is repeated for second dial indicator 70 to indicate the correct calendar month.

Figure 4:
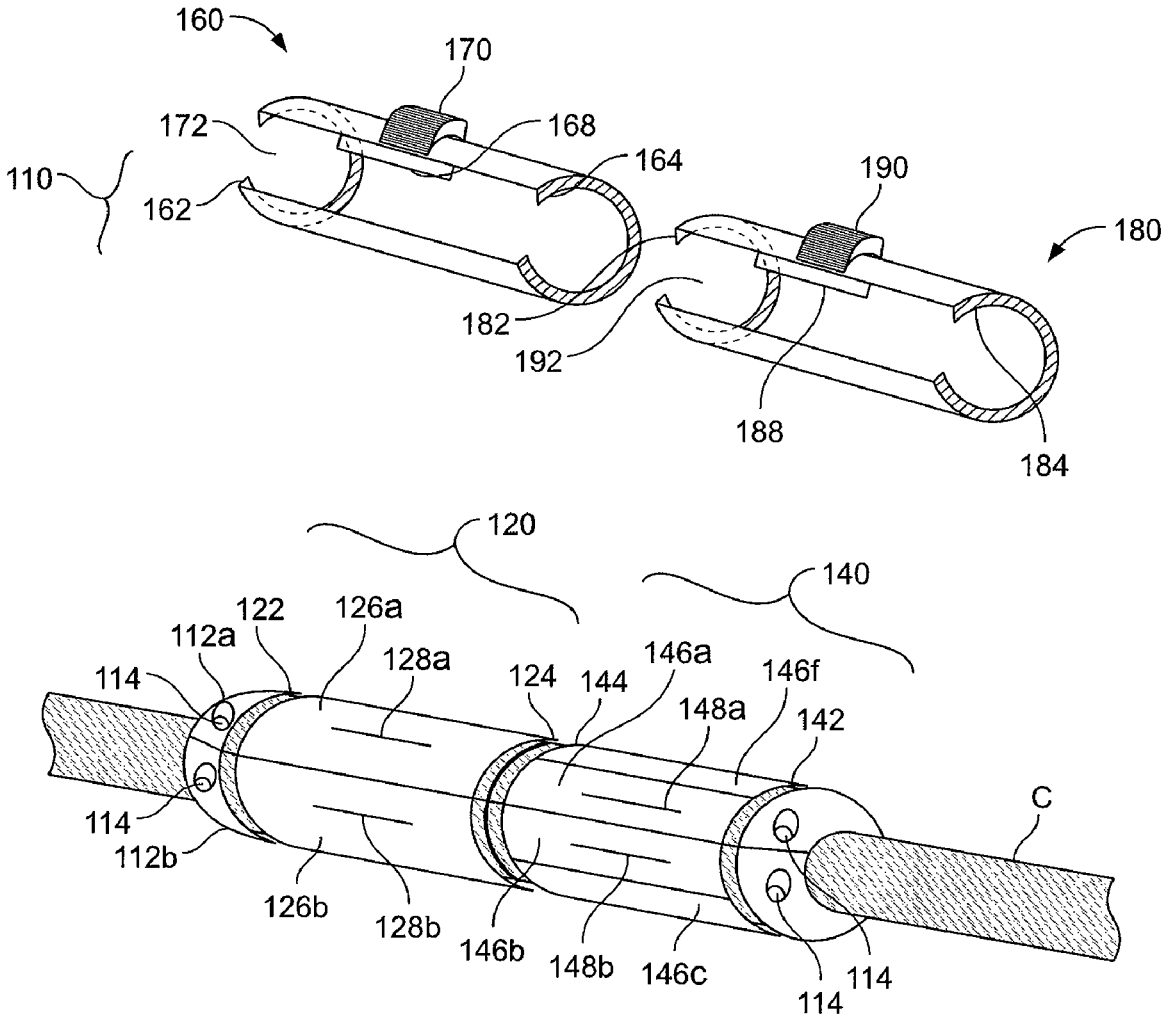
FIG. 4 shows a perspective view of a second embodiment of an assured grounding identifier.
Figure 5:
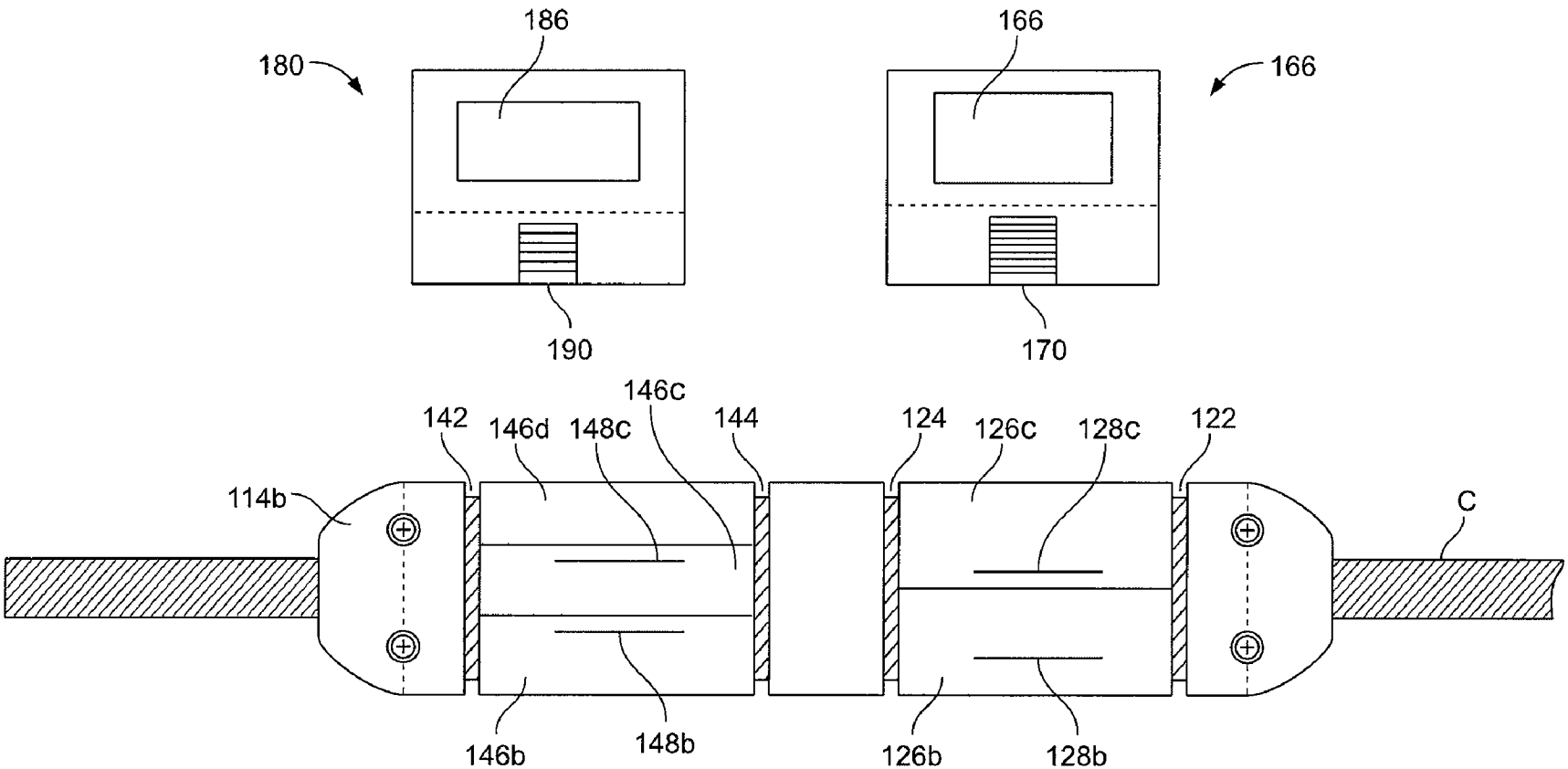
FIG. 5 shows a side view of a second embodiment of an assured grounding identifier.
Figure 5A:
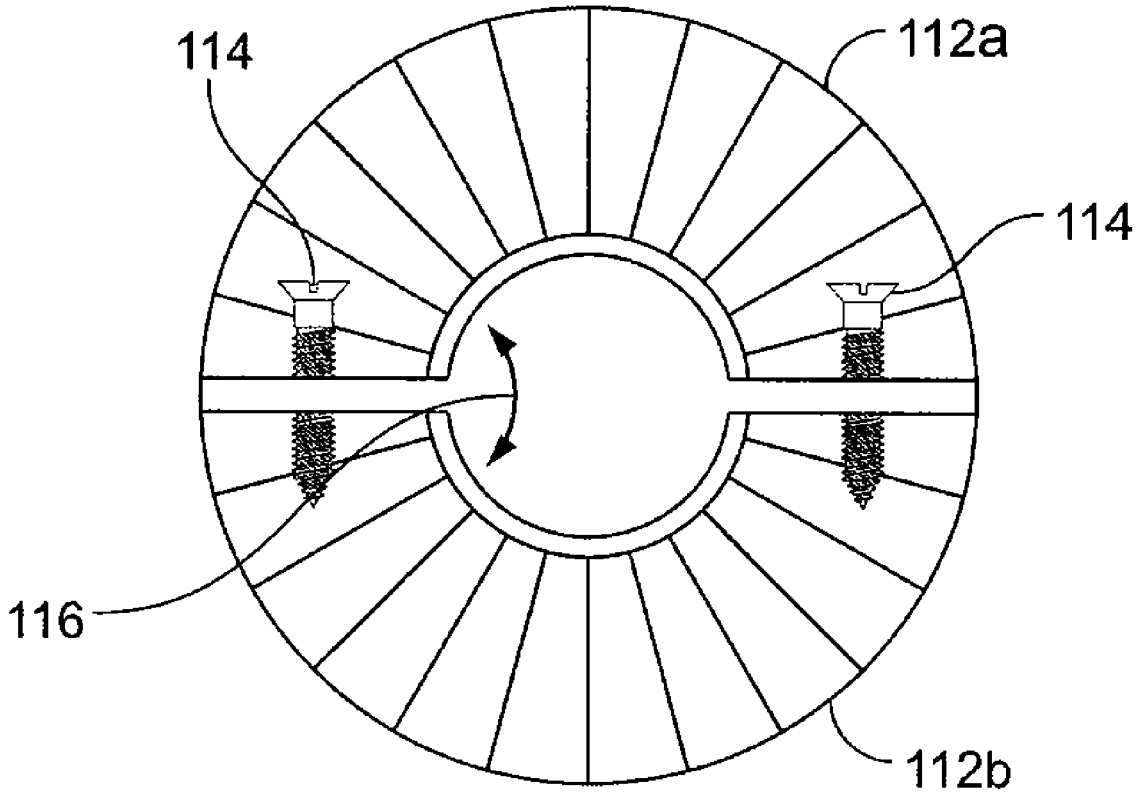
FIG. 5*a* shows an end-view of a second embodiment of an assured grounding identifier.
Figure 6:
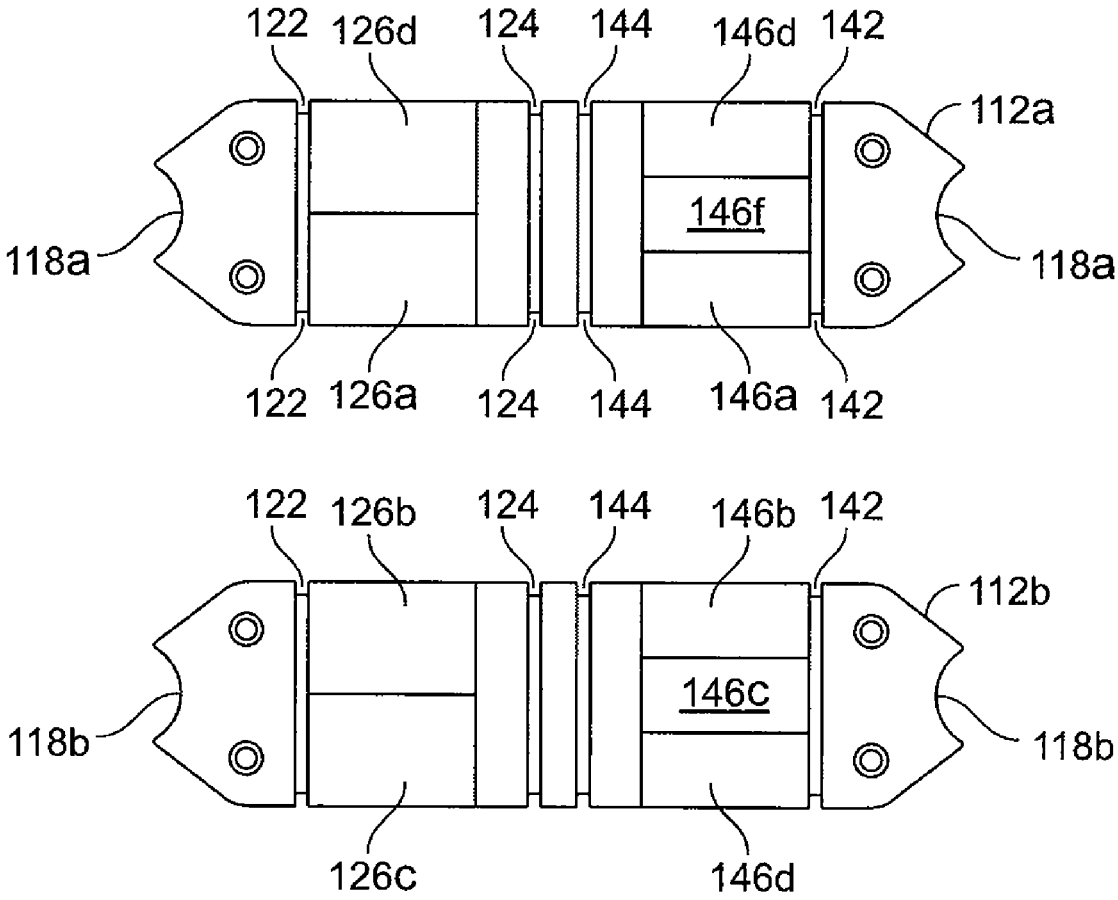
FIG. 6 shows the color scheme of a second embodiment of an assured grounding identifier.

As shown in FIGS. 4-6, in a second embodiment an assured grounding identifier 110 includes a base clamp 112 which grips an electrical cord C. Base clamp 112 includes a first part 112*a* and a second part 112*b*, with first and second open channels 118*a* and 118*b*, respectively, for receiving an electrical cord C between them. Base clamp first and second parts 112*a* & *b* are clamped together by threaded connectors 114. Preferably connectors 114 include retaining means such that they are retained when fully unthreaded. Alternatively, connectors 114 could comprise snaps or other suitable means. Preferably gripping sheet 116 is disposed within open channels 114*a* & *b* to prevent base clamp 112 from sliding along cord C. Preferably gripping sheet 116 consists of rubber or gripping foam material. Base clamp first and second parts 112*a* & *b* preferably include beveled edges to prevent chafing or cutting cord. Base clamp first and second parts 112*a* & *b* may be separate pieces, or may be connected by a hinge so as to close about cord C like a clam shell. When base clamp first and second parts 112*a* & *b* are clamped together around cord C, base clamp 112 forms a generally round cylindrical body.

Base clamp 112 includes first and second indicator portions 120 and 140, respectively. The outer surface of first indicator portion 120 is divided into four symmetrical color coded segments 126*a, b, c* & *d*, which are respectively white, green, red and orange, to conform to the standardized color scheme denoting the $1^{st}$, $2^{nd}$, $3^{rd}$ & $4^{th}$ yearly quarters for safety inspections. First indicator portion 120 includes first and second flange grooves 122 & 124, disposed around the circumference of first indicator portion 120 at opposing ends. Four axially aligned receiving slots 128*a, b, c* & *d* are disposed symmetrically around the circumference of first indicator portion 120 for selectively engaging locking tooth 168 on a first rotator clip 160.

First rotator clip 160 snaps around first indicator portion 120 and can be rotated around first indicator portion 120. First rotator clip 160 is circular in cross section and split axially on one side 172, such that it can be spread apart along the split 172 to snap around first indicator portion 120. First rotator clip 160 includes first and second engaging flanges 162 & 164 for engaging first and second flange grooves 122 and 124, respectively. First rotator clip 160 includes viewing window 166, the dimensions of which are preferably equal to or less than the dimensions of color coded segments 126*a-d* so that when window 166 is aligned with a color coded segment 126*a-d* only a single color coded segment 126*a-d* is visible at a time. First rotator clip 160 includes locking tooth 168 for selectively engaging a receiving slot 128*a-d* when window 166 is aligned with a respective color coded segment 126*a-d*. First rotator clip 160 preferably includes ridged thumb grip 170 for easy manipulation.

Second indicator portion 140 is similar to first indicator portion 120. The outer surface of second indicator portion 140 includes six color coded segments distributed symmetrically 146*a-f* arranged around the perimeter, respectively neutral, yellow, blue, neutral, yellow and blue. Second indicator portion 140 includes receiving slots 148*a-f*, arranged symmetrically about the perimeter of second indicator portion 140 for receiving an locking tooth 188 from second rotator clip 180. First and second flange grooves 142 and 144 encircle opposing ends of second indicator portion 140. Second rotator clip 180 snaps rotatingly onto second indicator portion 140. Alternatively, second indicator portion 140 could include only three color coded segments 148*a-c*, arranged around the perimeter, respectively neutral, yellow and blue. Using six color coded segments 146*a-f* rather than three segments may simplify manufacturing as no color segments will be split by a two-piece base clamp 112*a* & *b*.

Second rotator clip 180 is similar to first rotator clip 160. Second rotator clip 180 is generally circular in cross section and split axially on one side 192, such that it can be spread apart along the split 192 to snap around second indicator portion 140. Second rotator clip 180 includes first and second engaging flanges 182 and 184 for engaging first and second flange grooves 142 and 144, respectively. Second rotator clip 180 includes a viewing window 186, the dimensions of which preferably are equal to or less than the dimensions of color coded segments 146*a-f* so that when window 186 is aligned with a color coded segment 146*a-f* only a single color coded segment 146*a-f* is visible at a time. Second rotator clip 180 includes a locking tooth 188 for selectively engaging a receiving slot 148*a-f* when window 186 is aligned with a respective color coded segment 146*a-f*. Second rotator clip 180 preferably includes thumb grip 190.

In operation of the second embodiment, after completing required monthly grounding and safety inspections, the operator will manipulate thumb grip 170 to move locking tooth 168 out of its receiving slot 128, rotate first rotator clip about base unit 112 until the correct quarterly color indicator region 126 is visible through first rotator clip window 166, and lock first rotator clip in place by placing engaging tooth 168 into the corresponding receiving slot to prevent rotation. After setting the correct quarterly indication using the first rotator clip, the operator repeats the operation using the second rotator clip to the correct monthly color.

Figure 7:
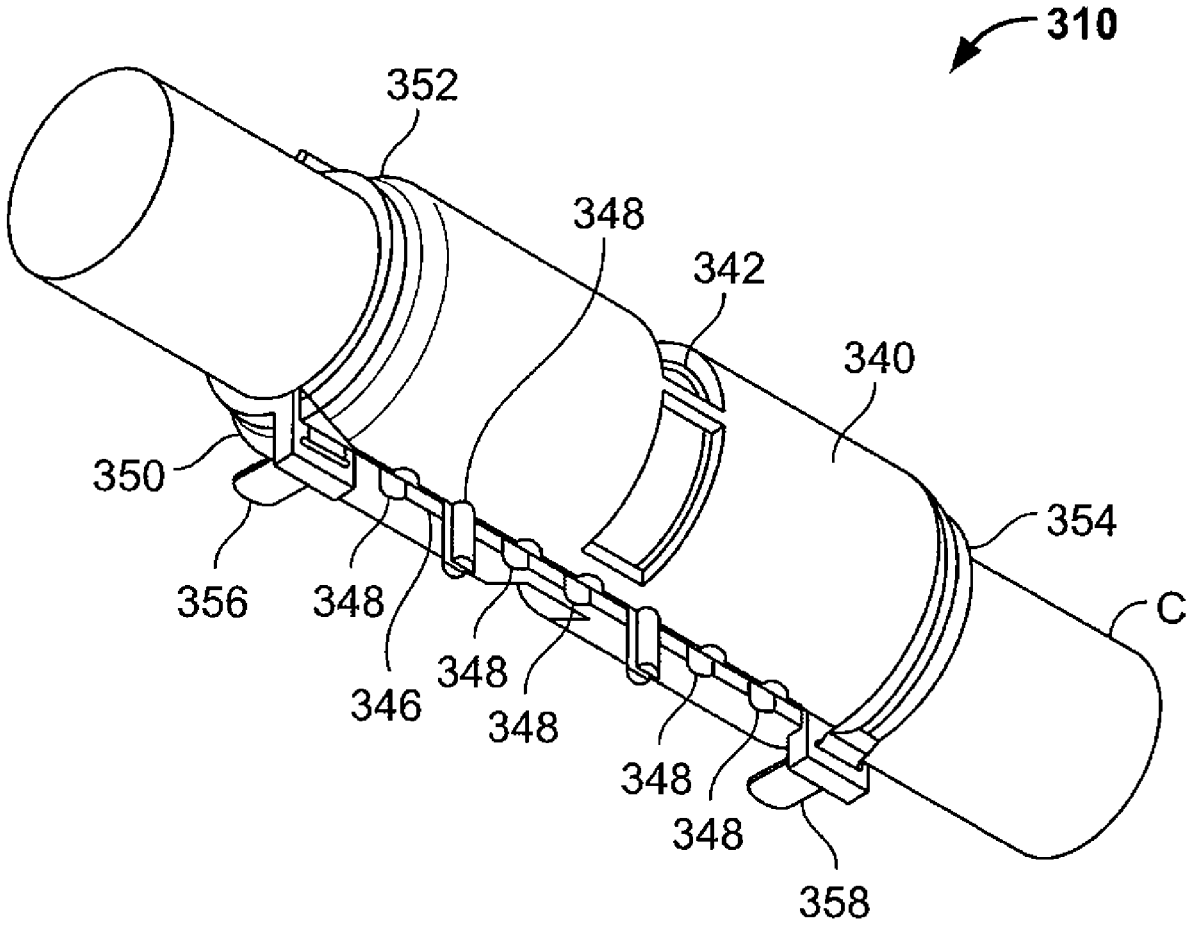
FIG. 7 shows a perspective view of third embodiment of an assured grounding identifier.
Figure 8:
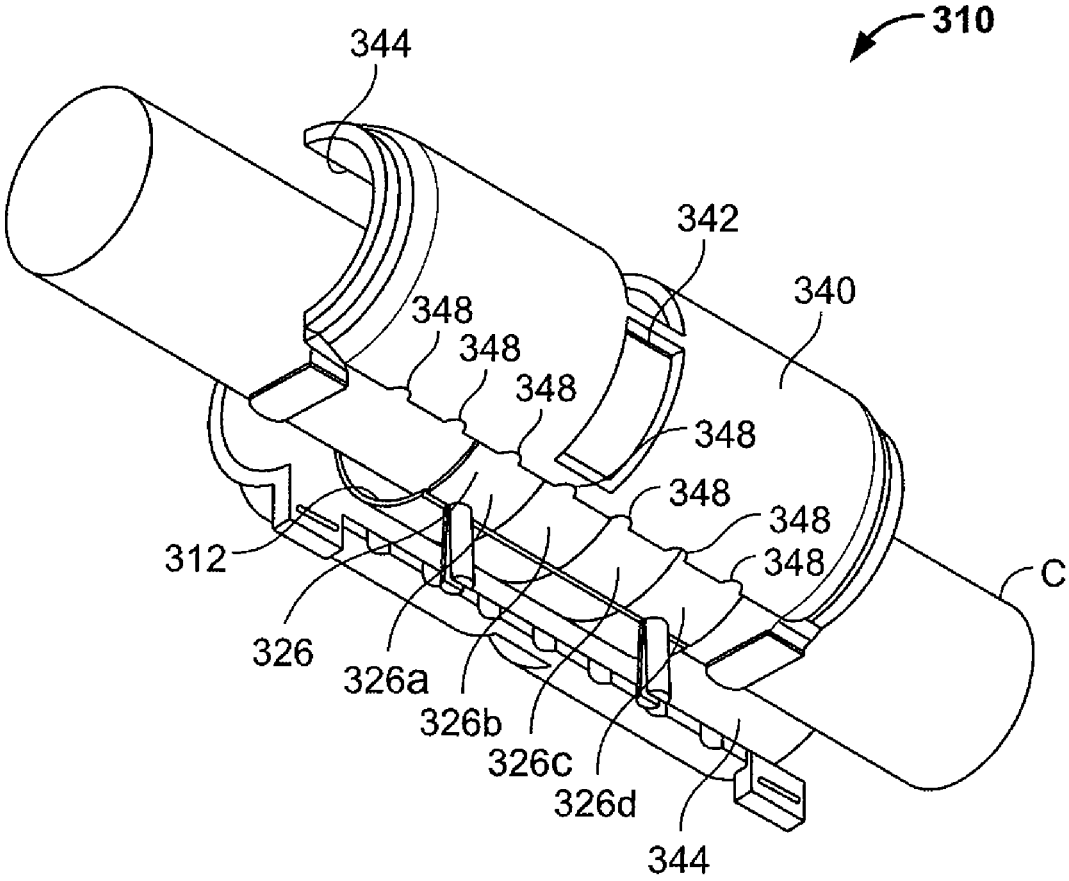
FIG. 8 shows a partially exploded perspective view of a third embodiment of an assured grounding identifier.
Figure 9:
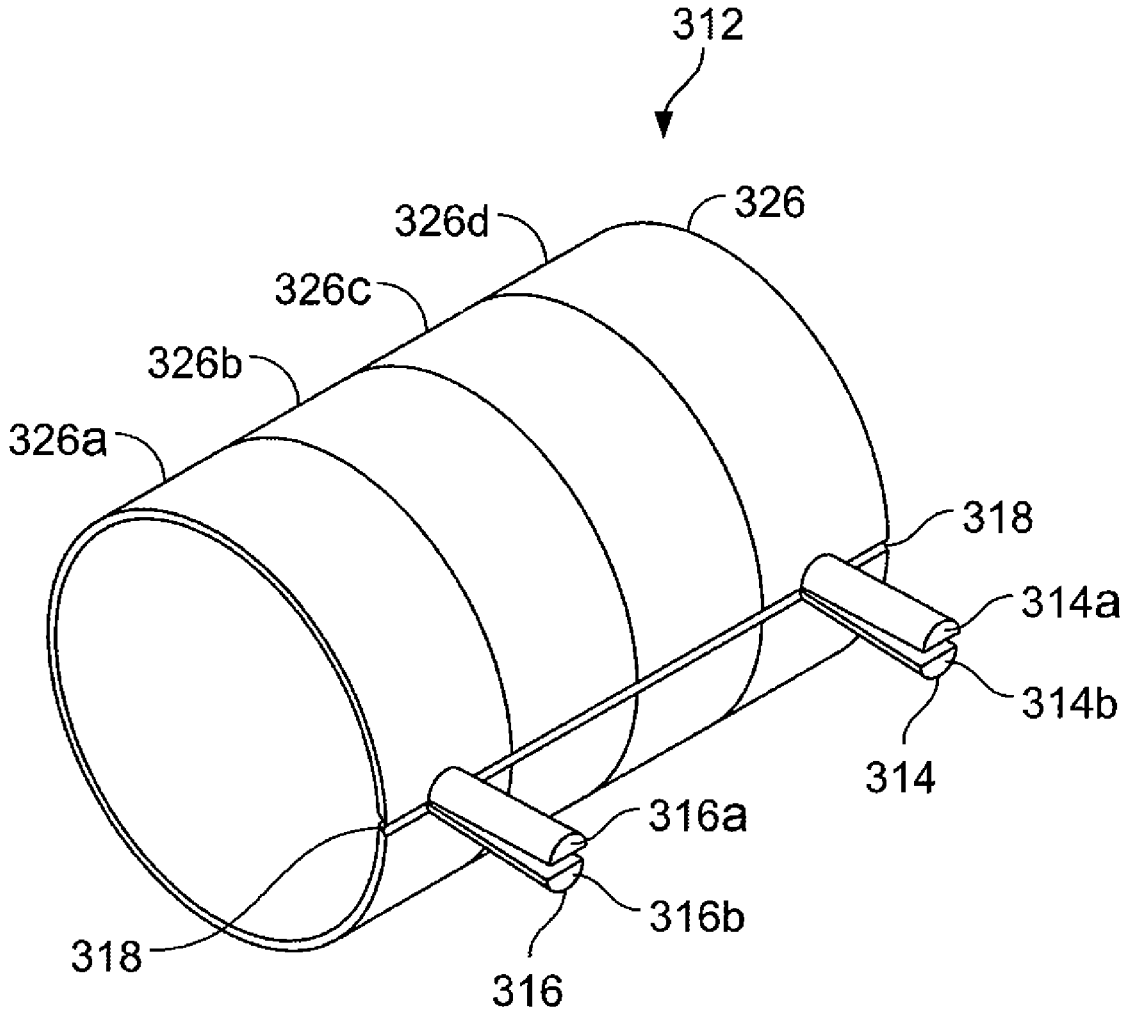
FIG. 9 shows a perspective view of an inner indicator spring of a third embodiment of an assured grounding identifier.
Figure 10:
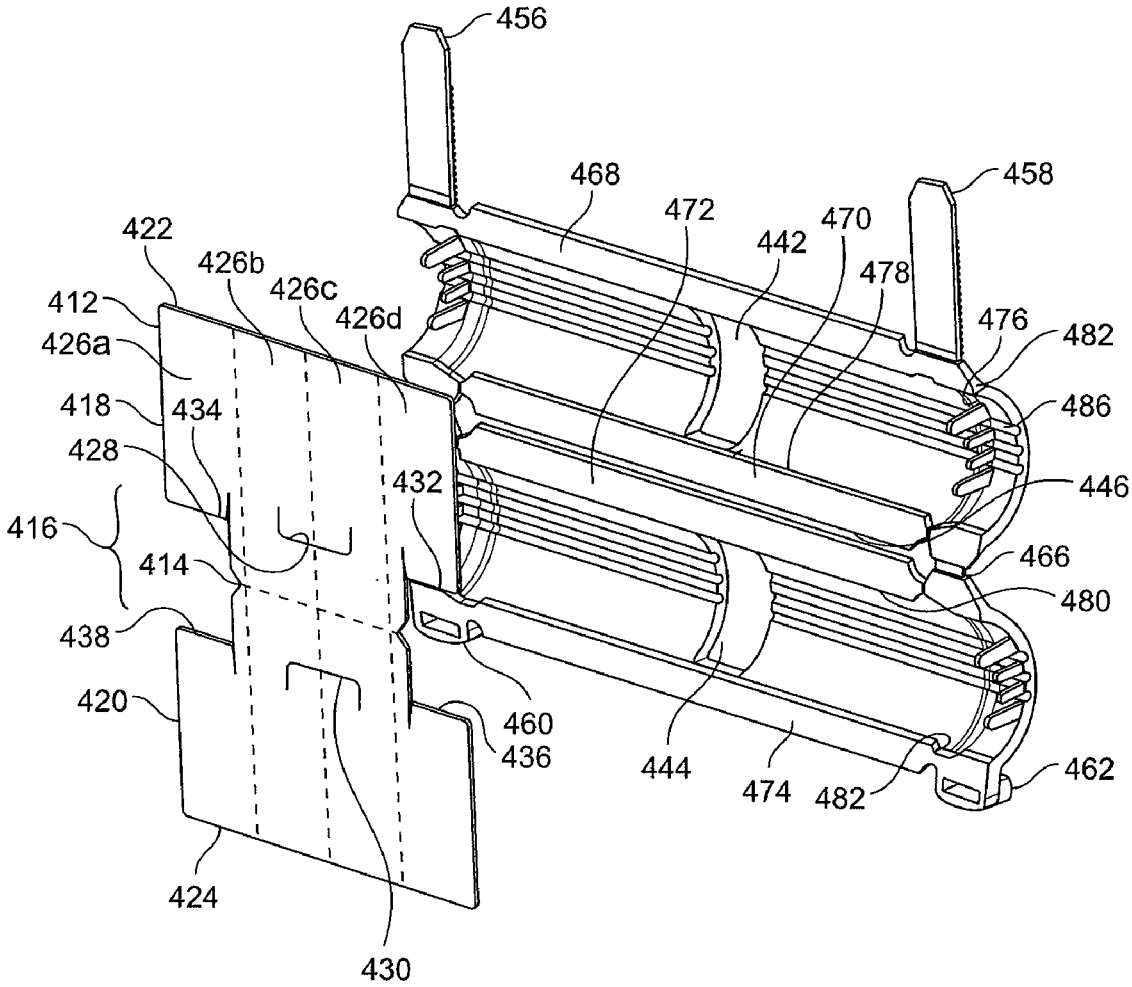
FIG. 10 shows an exploded view of a fourth embodiment of an assured grounding identifier.
Figure 11:
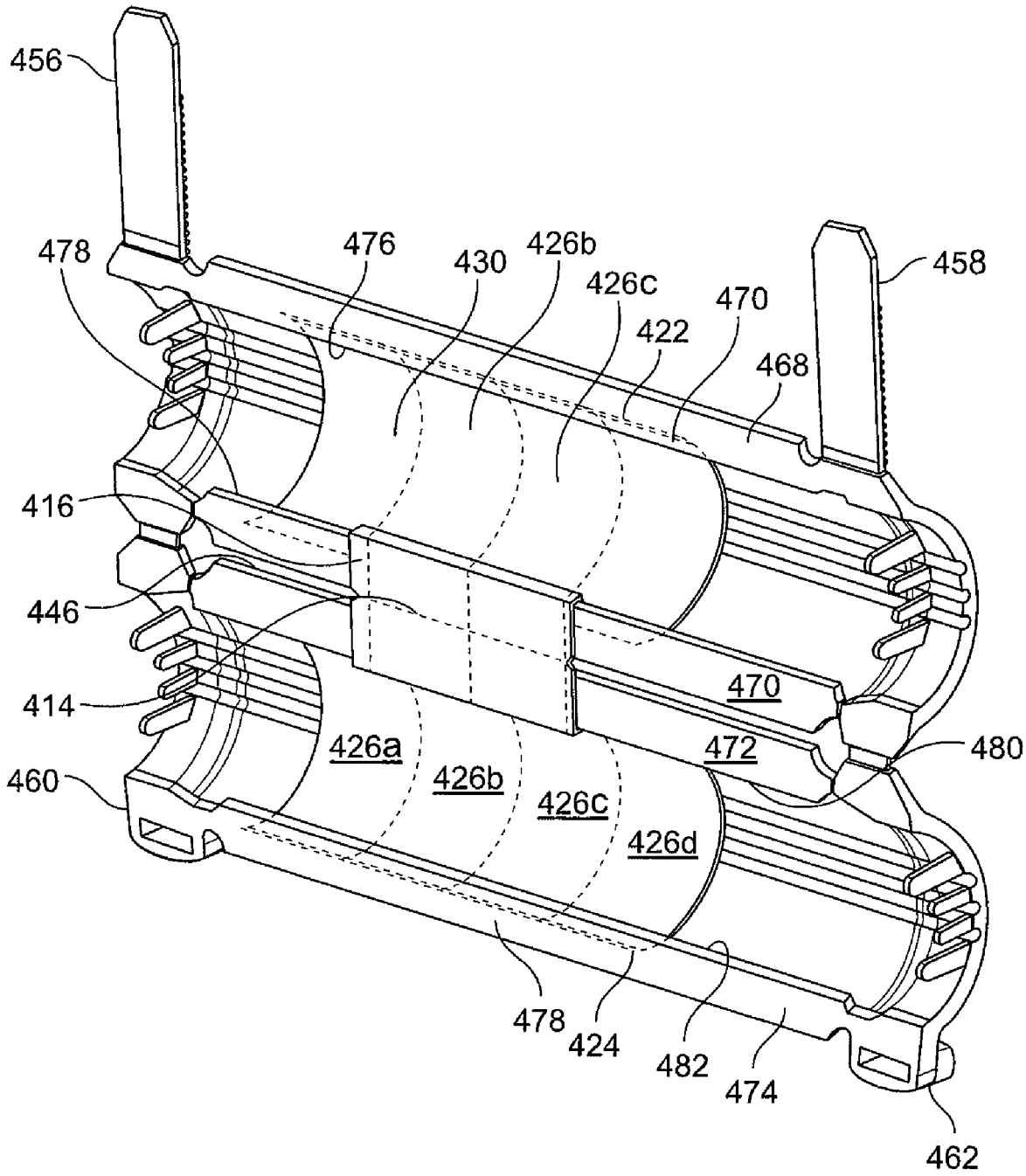
FIG. 11 shows a perspective view of a fourth embodiment of an assured grounding identifier.
Figure 12:
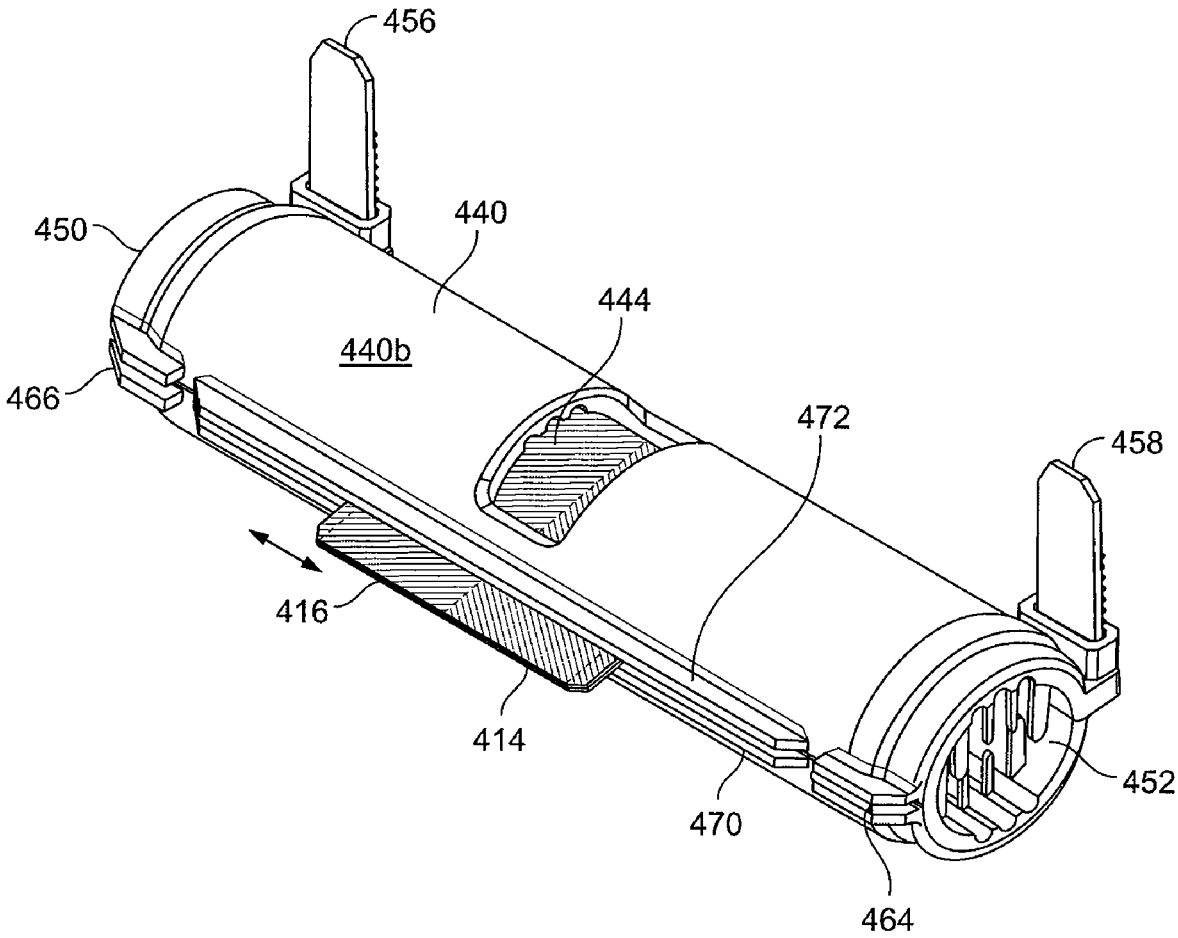
FIG. 12 shows perspective view of a fourth embodiment of an assured grounding indicator.
Figure 13:
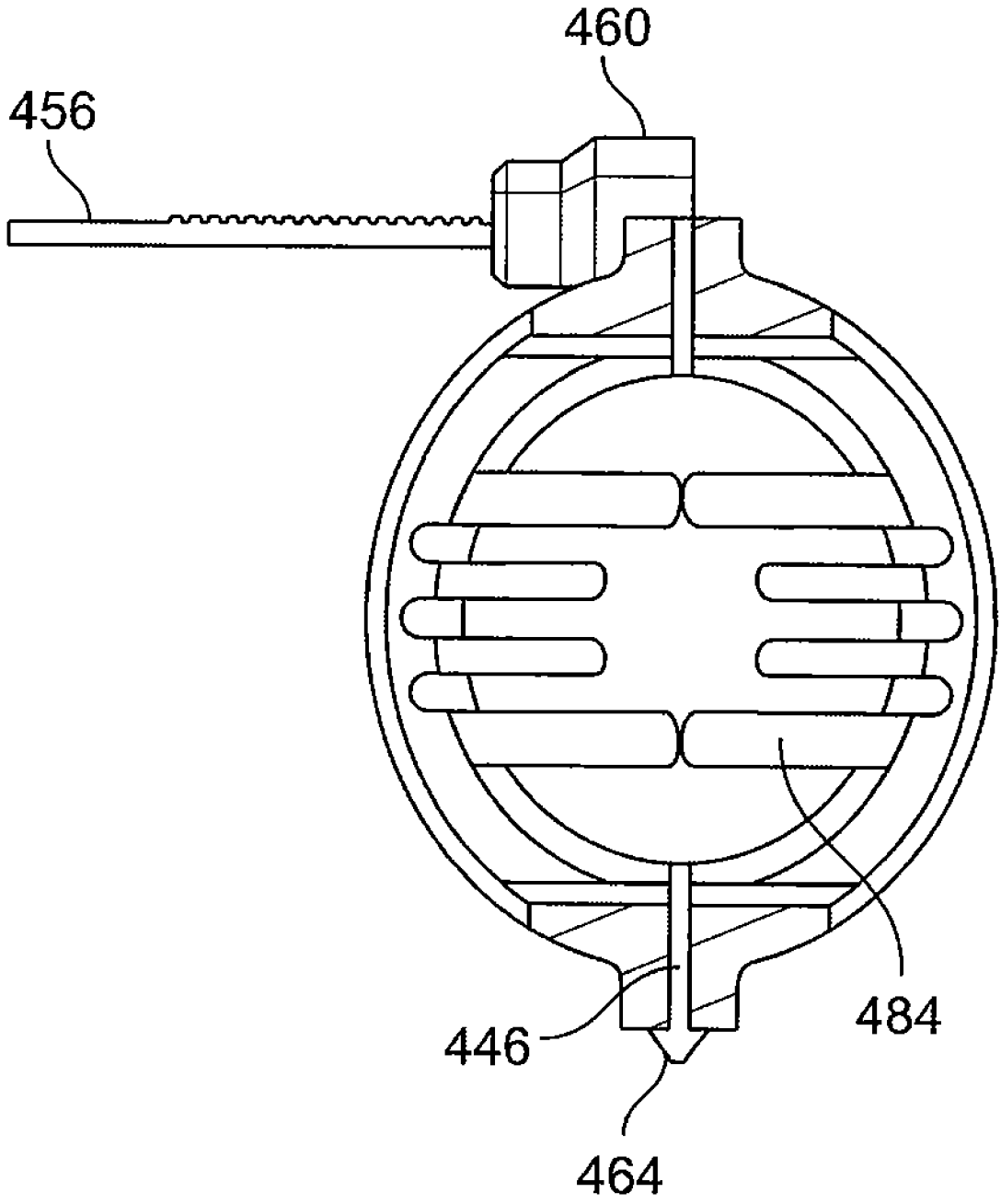
FIG. 13 shows an end view of a fourth embodiment of an assured grounding indicator.
Figure 14:
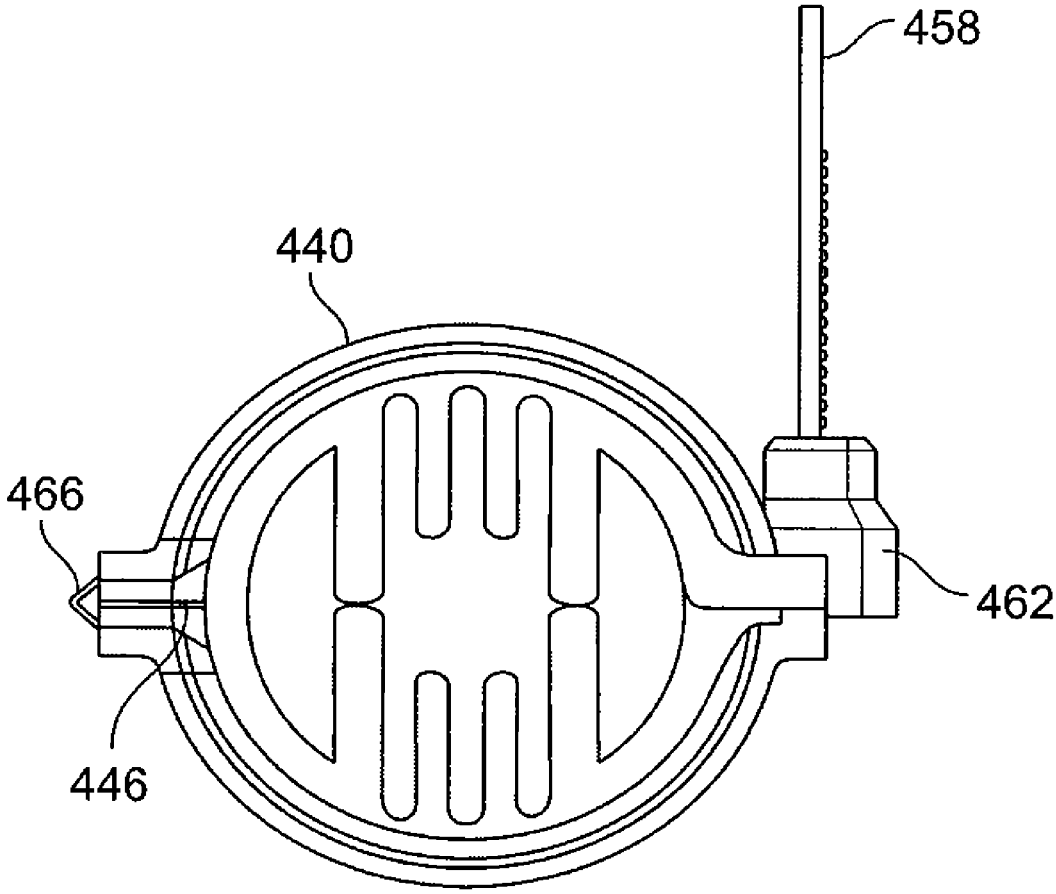
FIG. 14 shows an end view of a fourth embodiment of an assured grounding indicator.
Figure 15:
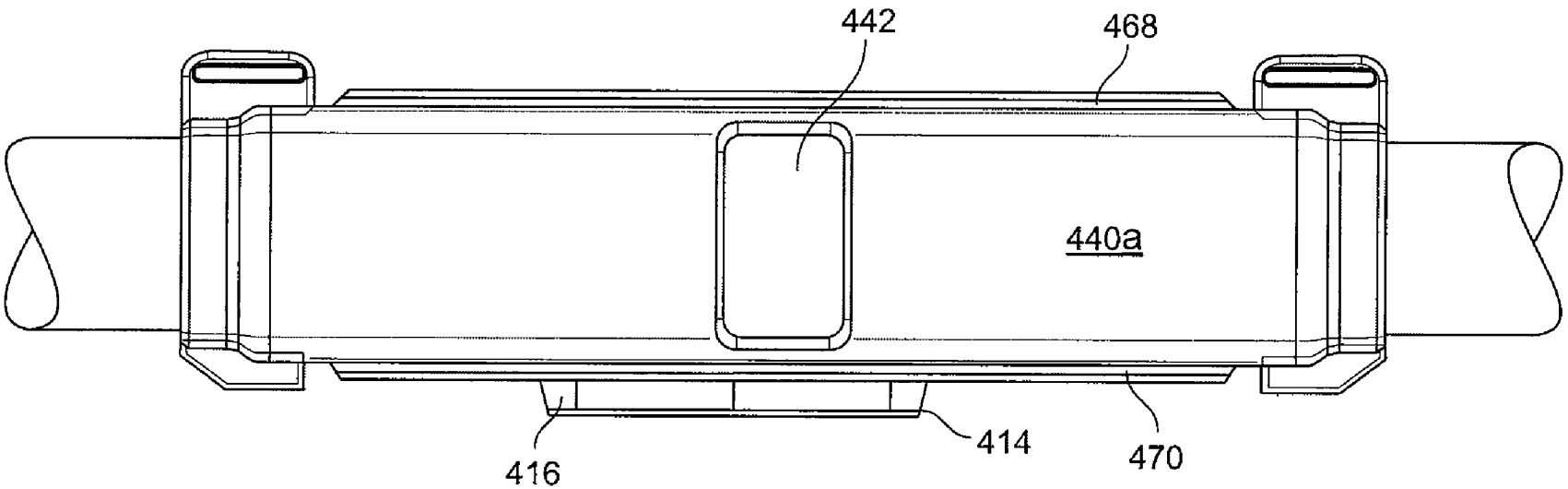
FIG. 15 shows a side view of a fourth embodiment of an assured grounding indicator.
Figure 16:
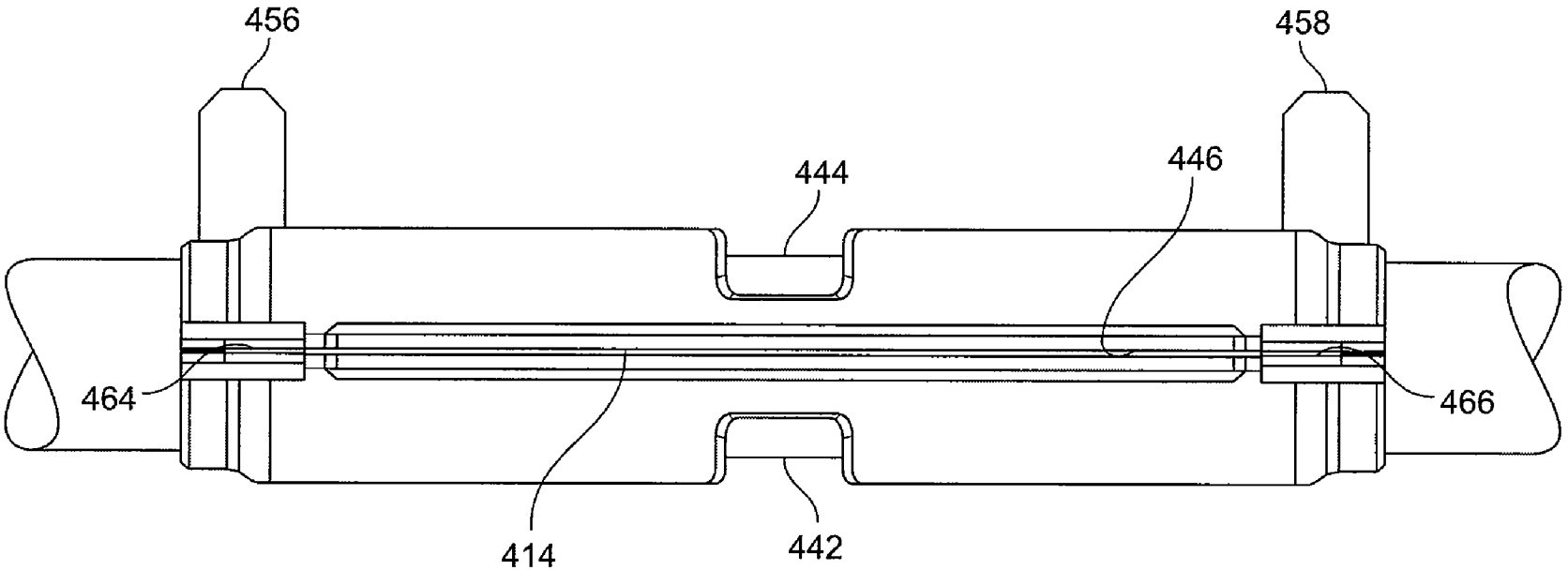
FIG. 16 shows another side view of a fourth embodiment of an assured grounding indicator.

Referring to FIGS. 7-9, a third embodiment of an assured grounding identifier 310 is shown, comprising an open-biased inner indicator spring 312 attachable to a selected electrical cord C and an outer clamp 340 attachable to said electrical cord C over said inner indicator spring 312. Inner indicator spring 312 comprises a hollow cylinder including a plurality of circumferential color coded bands 326*a-d* disposed along the outer surface 326 of inner indicator spring 312, an open seam 318 disposed axially along a side of inner indicator spring 312, and one or more finger clamps 314 and 316, respectively, wherein each of finger clamps 314 and 316 includes a pair of projections 314*a* & *b* and 316*a* & *b*, respectively, on opposing sides of open seam 318, such that compressing the pairs of projections 314*a* & *b* and 316*a* & *b*, respectively, together closes inner indicator spring 312. Outer clamp 340 comprises an indicator window 342 for selectively viewing the plurality of color coded bands 326*a-d*, an inner cavity 344 for allowing inner indicator spring 312 to slide linearly along electrical cord C within inner cavity 344 when outer clamp 340 is attached to electrical cord C around inner spring indicator 312, a notched slot 346 extending axially along a side of outer clamp 340 including a plurality of notches 348 along its length for selectively engaging finger clamp projections 314*a* & *b* and 316*a* & *b*, respectively, when inner indicator spring 312 is open so as to display a desired color coded band 326*a-d* through indicator window 342; and, cord clamp 350 for attaching outer clamp 340 to electrical cord C around inner indicator spring 312. Preferably an assured grounding identifier has color coded bands consisting of white, green, red and orange, respectively, to indicate calendar quarters. Alternatively, an assured grounding identifier can include an additional indicator with an inner indicator spring that includes three color coded bands, neutral, blue, and yellow, to indicate calendar months in combination with the four quarterly colors white, green, red, as in the chart on page 2 herein: January=white & neutral, February=white & yellow, March=white & blue, April=green & neutral, May=green & yellow, June=green & blue, July=red & neutral, August=red & yellow, September=red & blue, October=orange & neutral, November=orange & yellow, December=orange & blue. Cord clamp 350 preferably consists of first and second receiving channels 352 and 354, respectively, for receiving cable ties 356 and 358, with first and second receiving channels 352 and 354 located at opposing ends of outer clamp 340. Alternatively, cable ties 356 and 358 could be integrally formed with or attached to outer clamp 340, in which case assured grounding identifier 310 would not be reusable. Alternatively, cord clamp 350 could consist of snap fittings, snap hooks, threaded fasteners, or equivalent means. Outer clamp 340 may be formed in a single piece with a clam shell hinge to fit around cord C and inner spring indicator 312, or may be formed in two separate pieces for mating around cord C and inner indicator spring 312.

Referring to FIGS. 7-9, to operate the third embodiment described above, an operator attaches the assured grounding identifier to electrical cord C by first attaching inner indicator spring 312 over cord C, preferably near the plug end for visibility. Inner indicator spring 312 will fit loosely around cord C because it is biased open—i.e. its natural state is slightly separated along open seam 318. The operator then attaches outer clamp 340 around the cord C and inner indicator spring 312, such that finger clamps 314 and 316 project through notched slot 346. The open biasing of inner spring indicator 312 causes the opposing projections 314*a* & *b* and 316*a* & *b* of finger clamps 314 and 316, respectively, to push apart and seat themselves in notches 348, thereby holding inner indicator spring 312 in place. When projections 314*a* & *b* and 316*a* & *b* are aligned to engage notches 348, a single color coded band 326*a, b, c* or *d*, is visible through indicator window 342, indicating that safety checks have been completed for the calendar quarter corresponding to the color shown. To change the color coded band displayed, after completing grounding and safety checks for the calendar quarter, the operator squeezes closed finger clamps 314 and 316 and slides inner indicator spring 312 linearly along cord C within inner cavity 344 until the desired color coded band shows through indicator window 342, at which point the operator releases pressure on finger clamps 314 and 316, allowing their respective opposing projections 314*a* & *b* and 316*a* & *b* to spread apart (due to the open biasing of inner indicator spring 312) and engage the selected notches 348, which prevents further movement.

Referring to FIGS. 10-16, a fourth embodiment of an assured grounding identifier 410 is shown, including a housing 440 mountable around an electrical cord C, the housing 440 including a first viewing window 442 and a slot 446; and, an indicator 412 having a plurality of color-coded regions 426*a-d* and a positioning tab 416, the tab 416 extendable through slot 446 when indicator 412 is installed between housing 440 and electrical cord C. Tab 416 is movable within slot 446 to display a selected color-coded region 426*a-d* through viewing window 442.

In the embodiment, housing 440 is formed with opposing first and second half-cylindrical parts, 440*a* and 440*b*, hingedly connected to each other at first and second hinge connectors 464 and 466, respectively, which are spaced to create open slot 446 disposed lengthwise along housing 440. First and second housing parts 440*a* & *b* include first and second opposing viewing windows 442 and 444, respectively, for displaying a selected color-coded region 426*a-d* on opposing sides of assured grounding identifier 410. First and second housing parts 440*a* & *b* include ridges 486 aligned lengthwise, increasing longitudinal rigidity and allowing housing 440 to be formed into a cylinder and absorb transverse compression without buckling or kinking. First and second housing parts 440*a* & *b* include first and second cord clamps 450 and 452, respectively, at their opposing ends. In the embodiment cord clamps 450 and 452 are flexible pronds 484 extending transversely, which are compressed against cord C by tightening cable tie members 456 and 458 within cable tie locks 460 and 462, respectively.

In the embodiment, housing 440 includes flanges 468, 470, 472 and 474, with corresponding retaining lips 476, 478, 480 and 482, respectively, extending into the interior of housing 440. Indicator first and second edges 422 and 424, respectively, engage retaining lips 476 and 482, respectively, when indicator 412 is installed in housing 440. Preferably, indicator 412 includes first and second engaging flaps 428 and 430, respectively, formed into indicator 412. When indicator 412 is installed in housing 440 between cord C and housing 440, flaps 428 and 430 are inserted behind retaining lips 478 and 480, respectively, to provided improved capture of indicator 412 and ensure tab 416 is properly extended through slot 446 before closing housing 440 around cord C. Preferably, Indicator 412 is formed in a butterfly pattern with a narrow mid section to form tab 416 and wider wing sections 418 and 420, which creates side flaps 432, 434, 436 and 438, which engage retaining lips 478 and 480 similarly to flaps 428 and 430. Retaining lips 476, 478, 480 and 482 engaging flaps 428, 430, 432, 434, 436 and 438 prevent indicator 412 from being jostled out of position when cord C is moved around. Making tab 416 narrow also permits a greater range of movement within slot 446 to selectively position indicator 412 to display the desired color-coded band in viewing windows 442 and 446, thereby allowing a more compact device. Flanges 468, 470, 472 and 474 also increase longitudinal stiffness of housing 440.

In the embodiment, indicator 412 is a flexible sheet of plastic and color-coded regions 426*a-d* are printed color-coded bands corresponding to calendar quarters. Tab 416 is formed by folding indicator 412 along its midpoint to create a fold-edge 414 which is extended through slot 446. Engaging flaps 430 and 432 are formed into indicator 412. The color-coded bands may include monthly color indicators as well, or another visual coding system.

In operation, a user installs indicator 412 into an open housing 440 by first folding indicator 412 along its midsection at 414 to create a fold-edge at 414. The user then inserts fold-edge 414 through slot 446, inserts indicator first and second edges 422 and 424 behind engaging lips 476 and 482, respectively, inserts indicator flaps 428, 432 and 434 behind engaging lip 478, and inserts indicator flaps 430, 436 and 438 behind engaging lip 480. Housing 440 can then be closed around a cord C, and first and second cord clamps 450 and 452 are tightened by inserting cable tie parts 456 and 458 into 460 and 462, respectively, to compress flexible pronds 484 against cord C. Indicator 412 is disposed between cord C and housing 440, thereby surrounding cord C, and is therefore visible through both viewing windows 442 and 444. The user determines the proper color-coded region 426*a-d* to display through the viewing windows and slides tab 416 along slot 446 until the selected region is displayed. The retaining lips engaging the flaps retain indicator 412 in place under typical conditions until a user intentionally moves tab 416 to display a different selected color-coded region.

Figure 17:
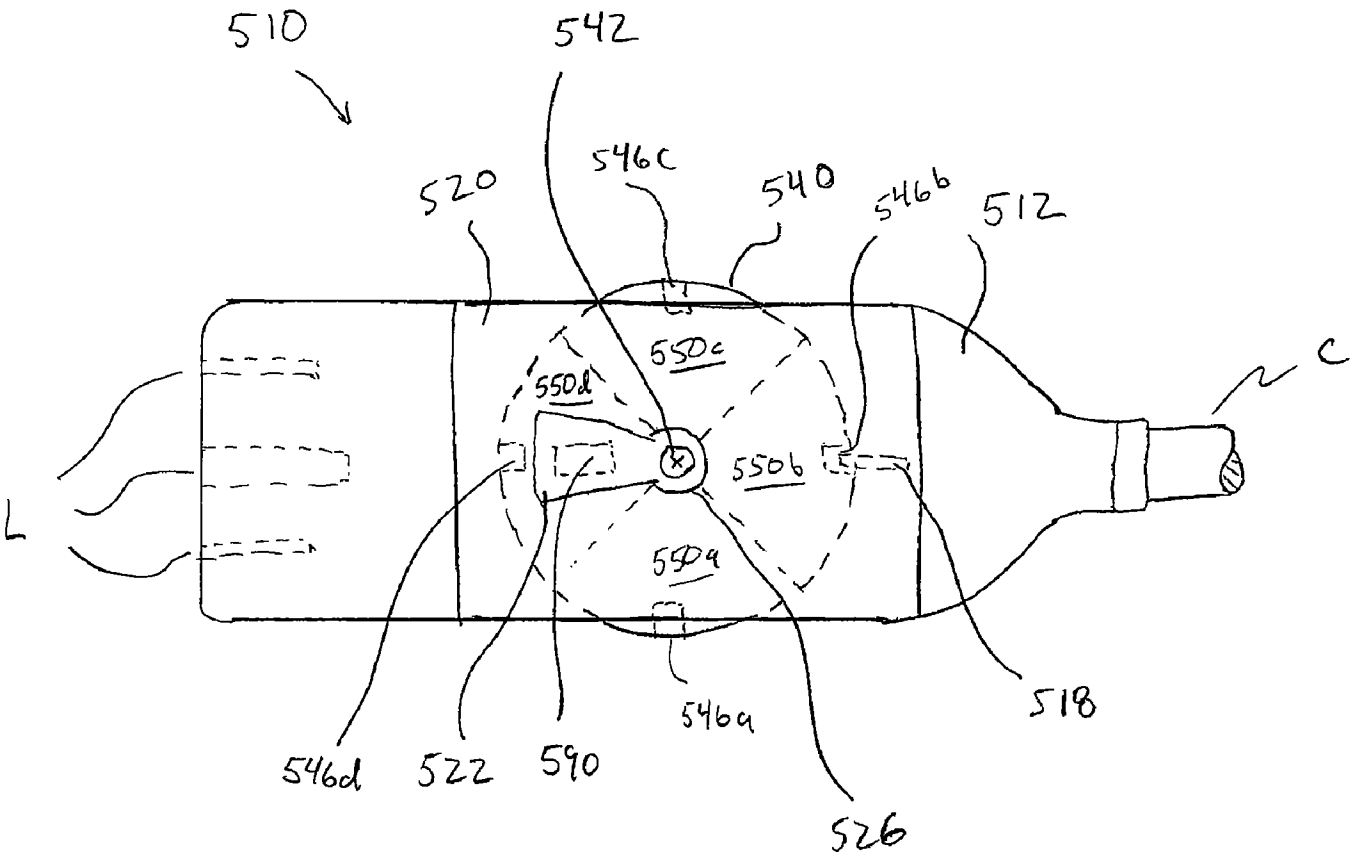
FIG. 17 shows top plan view of a fifth embodiment of an assured grounding indicator.
Figure 18:
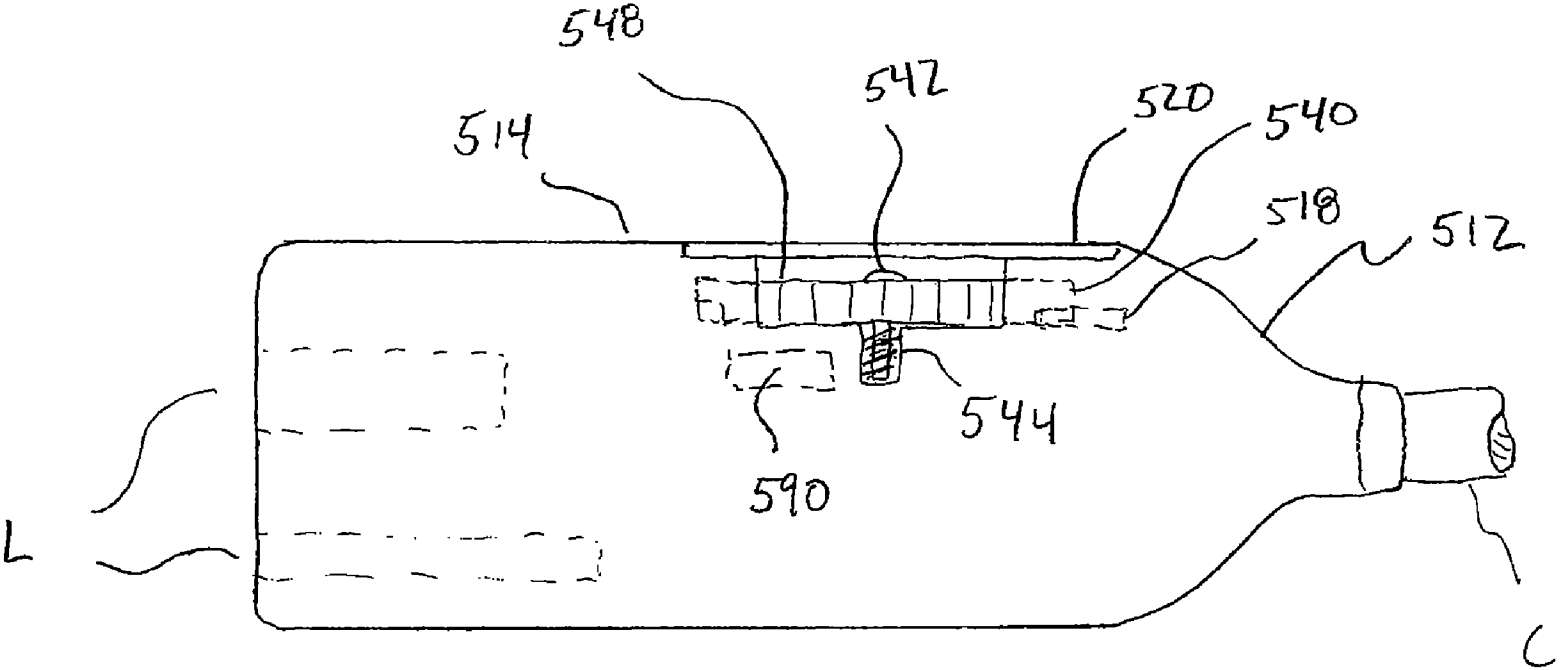
FIG. 18 shows a side view of a fifth embodiment of an assured grounding indicator.

Referring to FIGS. 17-18, a fifth embodiment of an assured grounding identifier 510 is shown, and includes a base unit 512 connected to an electrical cord C having conductors L therein, a first indicator 540 selectively adjustably mounted to the base unit 512, the first indicator 540 including a plurality of translucent color-coded regions 550*a-d*, an indicator cover 520 connected to the base unit 512 over at least the first indicator 540, the indicator cover 520 including a first viewing window 522 aligned with the first indicator 540, the first viewing window 522 dimensioned to display a single color-coded region 550*a-d* of the first indicator at a time, and, a first indicator light 590 contained within the base unit 512 and aligned with the first viewing window 522, the light 590 in electrical communication with the conductors L such that the first indicator light 590 illuminates when power is applied to the conductors L.

An assured grounding identifier can include a second indicator selectively adjustable mounted to the base unit 512 and similar in structure to the first indicator, the second indicator including a plurality of translucent color-coded regions; the indicator cover connected to the base unit over both the first and second indicators, the indicator cover including a second viewing window aligned with the second indicator, the second viewing window dimensioned to display a selected single color-coded region of the second indicator at a time; and a second indicator light contained within the base unit and aligned with the second viewing window, the light in electrical communication with the conductors such that the second indicator light illuminates when power is applied to the conductors.

As shown in FIGS. 17-18, in a preferred embodiment the assured grounding identifier 510 is formed into an electrical cord plug as a single unit, but could be a separately attached section in a built-up plug. In this embodiment the assured grounding indicator 510 is similar to the first disclosed embodiment in FIGS. 1-3. First dial indicator 540 is rotatingly connected to the display side 514 of base unit 512 using set screw 542. Base unit 512 includes a locking ridge 518 for engaging locking notches 546*a-d* on dial indicator 540.

First dial indicator 540 receives first set screw 542 through its central axes. Set screw 542 threads into base unit 512 to retain first dial indicators 540 in place after aligning over locking ridge 518. First indicator light 590 is positioned within base unit 512 and aligned with first viewing window 522, so that indicator light 590 will illuminate through the selected translucent color coded segment 550*a-d*. Preferably indicator light 590 is an LED which is hardwired to conductors L so that indicator light 590 automatically illuminates when power is applied to cord C.

First dial indicator 540 includes first dial spring 544. Dial spring 544 lifts dial indicator 540 away from base unit 512 and clear of locking ridge 518 when set screw 542 is loosened, thereby allowing an operator to freely turn dial indicator 540. Locking notches 546*a-d* must be aligned over locking ridge 518 to display the correct color code, at which point set screw 542 is tightened, compressing dial spring 544 and engaging the selected locking notches 546 onto locking ridge 518 to prevent rotation.

Preferably first indicator dials 540 is substantially flat and cylindrical in shape. As shown in FIGS. 17-18, in an embodiment first indicator dials 540 is a thin cylinder or wafer style.

First indicator dial 540 includes a display face 548 with four translucent color coded segments 550*a-d* arranged symmetrically around the central axis and corresponding to the designated quarterly colors: white, green, red, and orange. Preferably the four translucent color coded segments 550*a-d* are shaped wedge-shaped like pieces of a pie. Alternatively the four translucent color coded segments 550*a-d* could consist of colored strips oriented radially outward, or colored dots where the dots are large enough to be easily visible. First indicator dial 540 includes four locking notches 546*a-d* distributed symmetrically around the central axis for engaging locking ridge 518. Preferably locking notches 546*a-d* are disposed on an opposing side from display face 548. Alternatively, locking notches 546*a-d* could be cut through the perimeter edge of first indicator dial 540. In another alternative, locking ridge 518 could consist of a protrusion, and locking notches 546*a-d* could consist of detents aligned to receive the protrusions when indicator dial 540 is rotated to display a selected color coded segment 550*a-d*.

Display cover 520 attaches to base unit 512 over first indicator dial 540. Display cover 520 includes first display window 522, and first set screw access hole 526. First display window 522 is positioned such that when a first indicator dial locking notch 546*a-d* engages locking ridge 518 only one of translucent color coded segments 550*a-d* is visible through first display window 522.

In operation of the embodiment, an operator conducts ground checks and safety inspections required for the particular month on cord C in accordance with accepted procedures. If the cord passes the checks then the operator will indicate acceptance using the assured grounding identifier. The operator indicates the quarter by loosening set screw 542 allowing spring 544 to push first dial indicator 540 up until locking notch 546 clears locking ridge 518. The operator turns first dial indicator 540 until the correct color section 550 shows through first viewing window 522 to correspond to the calendar quarter, and the corresponding locking notch 546 is aligned with locking ridge 518, at which point set screw 542 is tightened down. When the cord C is plugged into an electrical power source, the light 590 will automatically illuminate and shine through the selected translucent color coded region 550, thereby providing enhanced visibility in low light conditions, and providing the added safety of indicating that the cord C is live.

An assured grounding identifier may include a second indicator similar to the first indicator. The second indicator is selectively adjustably mounted to the base unit, the second indicator including a plurality of translucent color-coded regions; the indicator cover connected to the base unit over both the first and second indicators, the indicator cover including a second viewing window aligned with the second indicator, the second viewing window dimensioned to display a selected single color-coded region of the second indicator at a time; and a second indicator light contained within the base unit and aligned with the second viewing window, the light in electrical communication with the conductors such that the second indicator light illuminates when power is applied to the conductors.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

We claim:

1. An assured grounding identifier, comprising:
a base unit, said base unit including a cord clamp;
a first indicator selectively adjustably mounted to said base unit, said first indicator including a plurality of color-coded regions;
an indicator cover connected to said base unit over at least said first indicator, said indicator cover including a first viewing window aligned with said first indicator, said first viewing window dimensioned to display a single color-coded region of said first indicator at a time.

2. An assured grounding identifier as in claim 1, further comprising:
a second indicator selectively adjustable mounted to said base unit, said second indicator including a plurality of color-coded regions;
said indicator cover connected to said base unit over both said first and second indicators, said indicator cover including a second viewing window aligned with said second indicator, said second viewing window dimensioned to display a selected single color-coded region of said second indicator at a time.

3. An assured grounding identifier, comprising:
a housing including a front portion and a back portion, wherein said front portion includes first and second spring chutes and a locking ridge, and wherein said back portion includes attachment means for attaching said housing to an electrical cord;
a first dial indicator rotatingly attached to said housing front portion through said first spring chute, said first dial indicator including:
a front surface and a back surface on opposing sides of said first dial indicator;
a plurality of color-coded regions distributed symmetrically around said front surface of said first dial indicator;
four locking grooves distributed symmetrically around said back surface of said first dial indicator for selectively engaging said locking ridge;
a second dial indicator rotatingly attached to said housing front portion through said spring chute, including:
a front surface and a back surface on opposing sides of said second dial indicator;
a plurality of color-coded regions distributed symmetrically around said front surface of said second dial indicator;
six locking grooves distributed symmetrically around said back surface of said second dial indicator for selectively engaging said locking ridge; and,
a housing front cover attachable over said housing front portion and said first and second dial indicators, said front cover including first and second set screw access holes for accessing said first and second set screws, respectively, and further including first and second indicator windows positioned over said first and second dial indicators, respectively, for selectively displaying said color-coded regions.

4. An assured grounding identifier as in claim 3, further comprising:

first and second dial springs contained in said first and second spring chutes, respectively.

5. An assured grounding identifier, comprising:

a cylindrical base unit connectable around an electrical cord, said base unit including a first portion wherein the outer surface of said first portion includes a plurality of color-coded regions, disposed circumferentially around said first portion; and, a first rotating clip selectively rotatingly attachable around said base unit first portion, said first rotating clip including:

a first viewing window; and, first locking mechanism for selectively locking said first rotating clip such that a selected color-coded region is visible through said first viewing window at a time.

6. An assured grounding identifier as in claim 5, further comprising:

wherein said cylindrical base unit further includes a second portion wherein the outer surface of said second portion includes a plurality of color-coded regions disposed circumferentially around said second portion;

a second rotating clip selectively rotatingly attachable around said base unit second portion, said second rotating clip including:

a second viewing window;

second rotating clip retaining means for retaining said second rotating clip to said base unit second portion;

second locking mechanism for selectively locking said second rotating clip such that a selected color-coded region is visible through said second viewing window at a time.

7. An assured grounding identifier, comprising:

an open-biased inner indicator spring attachable to a selected electrical cord and a housing attachable to said electrical cord over said inner indicator spring;

wherein said inner indicator spring comprises:

a hollow split-cylinder including a plurality of circumferential color-coded bands disposed along the outer surface of said cylinder and having an open seam disposed axially along a side of said cylinder, and one or more finger clamps disposed along said open seam, each of said one or more finger clamps comprises a pair of projections on opposing sides of said open seam, such that compressing said pair of projections together closes said inner indicator spring; and, wherein said housing includes:

an indicator window for selectively viewing said plurality of color coded bands;

an inner cavity for allowing said inner indicator spring to slide linearly along said electrical cord within said inner cavity when said housing is attached to said electrical cord around said inner spring indicator;

a notched slot extending axially along a side of said housing including a plurality of notches along its length for selectively engaging said one or more finger clamp projections when said inner indicator spring is open so as to display a desired color coded band through said indicator window; and, first and second cord clamps disposed at opposing ends of said housing.

8. An assured grounding identifier as in claim 7, wherein said first and second cord clamps comprise receiving channels for receiving cable ties.

9. An assured grounding identifier comprising:

a housing mountable around an electrical cord, said housing including a first viewing window and a slot; and, an indicator having a plurality of color-coded regions and a positioning tab, said tab extendable through said slot when said indicator is installed between said housing and said electrical cord, and movable within said slot for selectively displaying a color-coded region through said viewing window.

10. An assured grounding identifier as in claim 9, further comprising:

wherein said housing includes first and second opposing viewing windows.

11. An assured grounding identifier as in claim 9, further comprising:

wherein said indicator having a plurality of color-coded regions comprises a flexible sheet having a plurality of color-coded bands, and wherein said positioning tab is formed by folding said flexible sheet and extending the fold-edge of said flexible sheet through said slot.

12. An assured grounding identifier as in claim 11, further comprising:

wherein said housing further includes one or more retaining lips, and, wherein said flexible sheet further includes one or more engaging flaps formed into said sheet, such that when said indicator is installed between said housing and said cord each of said engaging flaps engages a retaining lip.

13. An assured grounding identifier, comprising:

a base unit connected to an electrical cord having conductors therein;

a first indicator selectively adjustably mounted to said base unit, said first indicator including a plurality of translucent color-coded regions;

an indicator cover connected to said base unit over at least said first indicator, said indicator cover including a first viewing window aligned with said first indicator, said first viewing window dimensioned to display a single color-coded region of said first indicator at a time; and, a first indicator light contained within said base unit and aligned with said first viewing window, said light in electrical communication with said conductors such that said first indicator light illuminates when power is applied to said conductors.

14. An assured grounding identifier as in claim 13, further comprising:

a second indicator selectively adjustable mounted to said base unit, said second indicator including a plurality of translucent color-coded regions;

said indicator cover connected to said base unit over both said first and second indicators, said indicator cover including a second viewing window aligned with said second indicator, said second viewing window dimensioned to display a selected single color-coded region of said second indicator at a time; and a second indicator light contained within said base unit and aligned with said second viewing window, said light in electrical communication with said conductors such that said second indicator light illuminates when power is applied to said conductors.

* * * * *